US010578989B2

(12) United States Patent
Yoshihara et al.

(10) Patent No.: US 10,578,989 B2
(45) Date of Patent: Mar. 3, 2020

(54) ELECTROSTATIC CHARGE IMAGE DEVELOPER, DEVELOPER CARTRIDGE, AND PROCESS CARTRIDGE

(71) Applicant: FUJI XEROX CO., LTD., Tokyo (JP)

(72) Inventors: Kotaro Yoshihara, Kanagawa (JP); Daisuke Ishizuka, Kanagawa (JP); Narumasa Sato, Kanagawa (JP); Yuka Kawamoto, Kanagawa (JP); Erina Saito, Kanagawa (JP); Takahisa Tatekawa, Kanagawa (JP); Noriyuki Mizutani, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/892,998

(22) Filed: Feb. 9, 2018

(65) Prior Publication Data

US 2018/0275543 A1 Sep. 27, 2018

(30) Foreign Application Priority Data

Mar. 24, 2017 (JP) ..... 2017-058886

(51) Int. Cl.
*G03G 9/08* (2006.01)
*G03G 9/113* (2006.01)
(Continued)

(52) U.S. Cl.
CPC ..... *G03G 9/0825* (2013.01); *G03G 9/0819* (2013.01); *G03G 9/0827* (2013.01); *G03G 9/08711* (2013.01); *G03G 9/08755* (2013.01); *G03G 9/09321* (2013.01); *G03G 9/09328* (2013.01); *G03G 9/09364* (2013.01); *G03G 9/09371* (2013.01); *G03G 9/09716* (2013.01); *G03G 9/09725* (2013.01); *G03G 9/1075* (2013.01); *G03G 9/1133* (2013.01); *G03G 9/1139* (2013.01); *G03G 15/0865* (2013.01); *G03G 21/1814* (2013.01)

(58) Field of Classification Search
CPC ..... G03G 9/0825; G03G 9/09328; G03G 15/0865; G03G 9/09371; G03G 9/09364; G03G 9/0819; G03G 9/08755; G03G 9/08711; G03G 21/1814
See application file for complete search history.

(56) References Cited

U.S. PATENT DOCUMENTS

2014/0356783 A1* 12/2014 Yoshifuku ..... G03G 9/1132 430/111.35
2016/0085168 A1* 3/2016 Iwazaki ..... G03G 9/08755 430/105

FOREIGN PATENT DOCUMENTS

JP 2002-258530 A 9/2002
JP 2003-015348 A 1/2003
JP 2011-180298 A 9/2011

* cited by examiner

*Primary Examiner* — Thorl Chea
(74) *Attorney, Agent, or Firm* — Sughrue Mion, PLLC

(57) ABSTRACT

An electrostatic charge image developer includes: a toner that includes toner particles which contain a polyester resin and a styrene (meth)acrylic resin and form a sea-island structure which includes a sea portion containing the polyester resin and an island portion containing the styrene (meth)acrylic resin on a surface of the toner particle, and has an exposure rate of the styrene (meth)acrylic resin in a range of from about 5 atom % to about 20 atom %; and an external additive, and a carrier whose fluidity and bulk density under environment of a temperature of 25° C. and a humidity of 50% satisfy Expression: 65.0≤fluidity×bulk density≤72.5.

16 Claims, 2 Drawing Sheets

(51) Int. Cl.

| | |
|---|---|
| ***G03G 9/097*** | (2006.01) |
| ***G03G 9/087*** | (2006.01) |
| ***G03G 15/08*** | (2006.01) |
| ***G03G 21/18*** | (2006.01) |
| ***G03G 9/093*** | (2006.01) |
| ***G03G 9/107*** | (2006.01) |

ELECTROSTATIC CHARGE IMAGE DEVELOPER, DEVELOPER CARTRIDGE, AND PROCESS CARTRIDGE

CROSS-REFERENCE TO RELATED APPLICATIONS

This application is based on and claims priority under 35 USC 119 from Japanese Patent Application No. 2017-058886 filed Mar. 24, 2017.

BACKGROUND

1. Technical Field

The present invention relates to an electrostatic charge image developer, a developer cartridge, and a process cartridge.

2. Related Art

A method of visualizing image information such as an electrophotographic method is used in various technical fields in recent years. In the electrophotographic method, an electrostatic charge image is formed on a surface of an image holding member as image information through charging and electrostatic charge image forming. In addition, a toner image is formed on the surface of the image holding member with a developer containing toner, then the toner image is transferred to a recording medium, and the toner image is fixed on the recording medium. Through these steps, the image information is visualized as an image.

SUMMARY

According to an aspect of the invention, there is provided an electrostatic charge image developer including:

a toner that includes toner particles which contain a polyester resin and a styrene (meth)acrylic resin and form a sea-island structure which includes a sea portion containing the polyester resin and an island portion containing the styrene (meth)acrylic resin on a surface of the toner particle, and has an exposure rate of the styrene (meth)acrylic resin in a range of from about 5 atom % to about 20 atom %; and an external additive, and a carrier whose fluidity and bulk density under environment of a temperature of 25° C. and a humidity of 50% satisfy Expression: 65.0≤fluidity×bulk density≤72.5.

BRIEF DESCRIPTION OF THE DRAWINGS

Exemplary embodiments of the present invention will be described in detail based on the following figures, wherein.

DETAILED DESCRIPTION

Figure 1:
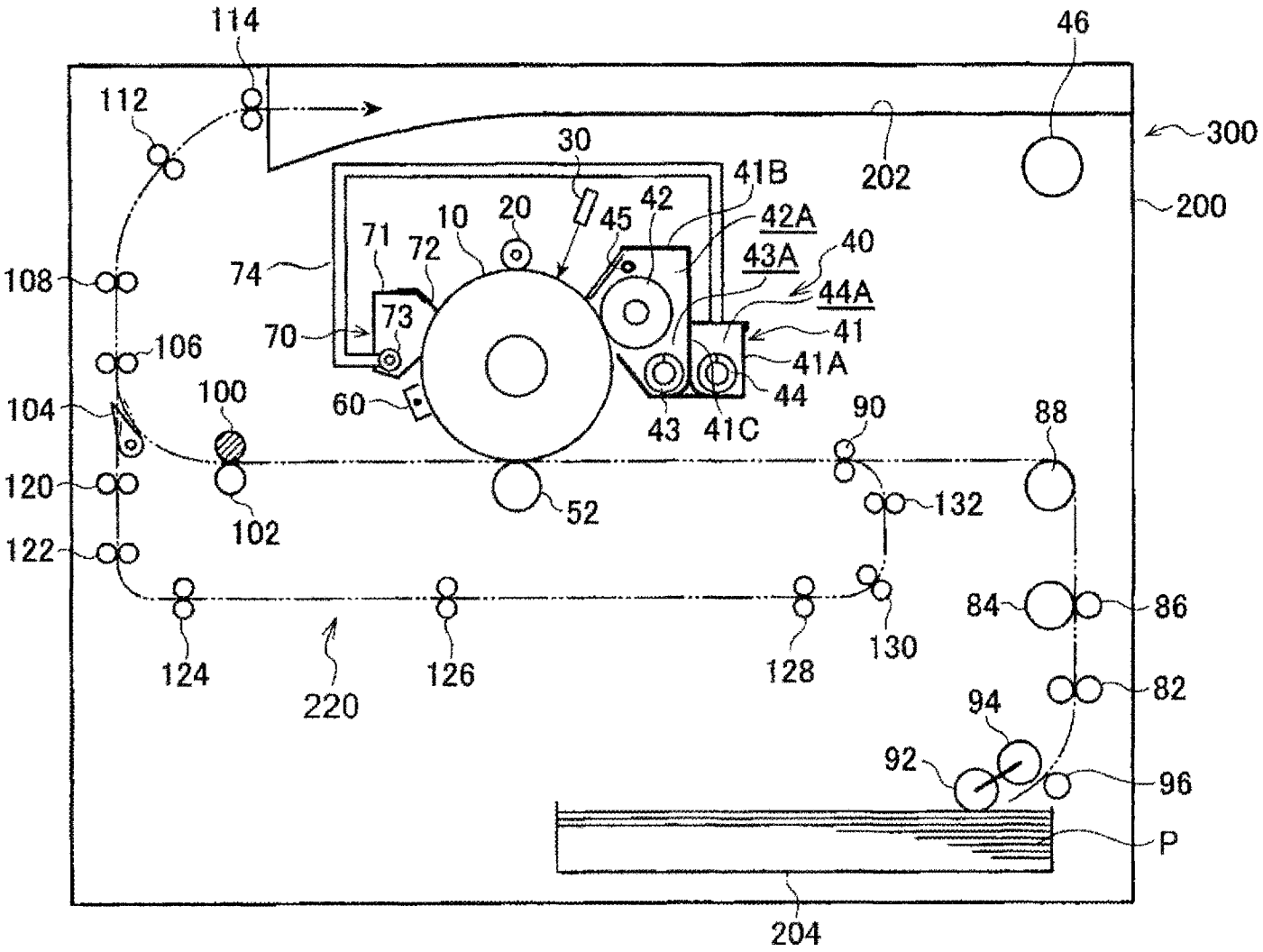
FIG. 1 is a configuration diagram illustrating an example of an image forming apparatus according to the exemplary embodiment.

Hereinafter, the exemplary embodiment which is an example of the invention will be described in detail.

Electrostatic Charge Image Developer

An electrostatic charge image developer (hereinafter, referred to as an "image developer") according to the exemplary embodiment includes a toner containing toner particles and external additives, and a carrier.

The toner particles contain a polyester resin and a styrene (meth)acrylic resin, and form a sea-island structure which includes a sea portion containing a polyester resin and an island portion containing a styrene (meth)acrylic resin on a surface of the toner particle, and has an exposure rate of the styrene (meth)acrylic resin in a range of from 5 atom % or about 5 atom % to 20 atom % or about 20 atom %.

In the carrier, fluidity and bulk density satisfy Expression: 65.0≤fluidity×bulk density≤72.5 under the environment of a temperature of 25° C. and a humidity of 50%.

Here, in a toner reclaim type image forming apparatus, the toner removed by a cleaning unit is supplied to a developing unit. Here, the toner removed by the cleaning unit and then supplied to the developing unit is also referred to as a "reclaimed toner".

For this reason, a mechanical load is applied to the reclaimed toner by cleaning, and thus external additives are likely to be embedded into the surface of the toner particle. In addition, the reclaimed toner in a state where the external additives are embedded into the surface of the toner particle is supplied to the developing unit. In addition, the embedding of the external additives into the surface of the toner particle proceeds, the reclaimed toner is difficult to transfer from the image holding member and is repeatedly supplied to the developing unit.

When such a "reclaimed toner in which the embedding of the external additives proceeds" is present in the developing unit, toners are aggregated to form a toner agglomerate (hereinafter, also referred to as a "soft agglomerate") having relatively low cohesion.

The soft agglomerate is formed by, for example, 1) an increase of an electrostatic adhesive force caused by a difference in charging due to a difference in the embedded state of the external additives between the reclaimed toner and the toner which is replenished from the toner cartridge, and 2) an increase of a non-electrostatic adhesive force on the surface of the toner particle due to the embedding of the external additives of the reclaimed toner. Particularly, due to the embedding of the external additives, the reclaimed toner has the deteriorated fluidity, and thus is likely to accumulate in positions where the flow of the toner and the developer is poor in the developing unit, and with this, it is likely to form a soft agglomerate.

On the other hand, after formed the soft agglomerate, due to the mechanical and thermal loads in the developing unit, a toner agglomerate (hereinafter, also referred to as "hard agglomerate") having a strong cohesive force.

In addition, the hard agglomerate clogs between a layer regulating member that regulates the layer thickness of the electrostatic charge image developer held by a developer holding member and the developer holding member in the developing unit, and the streaky image defects occur.

Particularly, the streaky image defects remarkably occur when the image formation with low image density is repeatedly performed, then the image formation is repeatedly performed on both sides of the recording medium, and the next day, an image with high image density is formed. The reason for this is as follows.

When the image formation with low image density is repeatedly performed, the toner consumption is low, and the mechanical load continues to be applied to the same toner in the developing device.

Therefore, the embedding of the external additives to the surface of the toner particle is performed, and the soft agglomerate is likely to be formed. After that, when the image formation is repeatedly performed on both sides of the recording medium, the inside temperature of the apparatus is increased, the thermal load is applied to the toner in addition to the mechanical load in the developing unit, and the soft agglomerate is likely to be the hard agglomerate.

In addition, when an image with a high image density is formed the next day after the inside temperature of the apparatus is decreased, the hard agglomerate clogs between the layer regulating member and the developer holding member, and thereby the streaky image defects are likely to occur.

In contrast, with such a configuration, the image developer according to the exemplary embodiment is presumed that in the toner reclaim type (type of removing the toner remaining from the surface of the image holding member, and the supplying the removed toner to the developing unit) image forming apparatus, the image formation with low image density is repeatedly performed, then the image formation is repeatedly performed on both sides of the recording medium, and the next day, the streaky image defects that occur when an image is formed with high image density are prevented. The reason for this is presumed as follows.

In the toner particles in which the sea-island structure is formed on the surface of the toner particle, even when the external additives are embedded, the island portion containing a styrene (meth)acrylic resin (that is, an exposed styrene (meth)acrylic resin) has a difference in triboelectric series with the polyester resin, and thus electric charges are likely to accumulate in the island portion which functions as a charge-controlling agent and contains a styrene (meth) acrylic resin, and the electric charge polarization of the surface of the toner particle is controlled to make the charge distribution substantially uniform.

For this reason, when the surface of the toner particle is exposed to the styrene (meth)acrylic resin within the above range, the difference in charging due to the difference in the embedded state of the external additives between the reclaimed toner in which the embedding of the external additives proceeds and the toner which is replenished from the toner cartridge is small, the electrostatic adhesive force of the toner is deteriorated.

Since the charge polarization on the toner surface is prevented, the charge distribution on the surface of the carrier is also made to be uniform, so that an appropriate repulsive force acts between the carriers, and the mechanical load (friction load) on the toner is reduced.

Further, the surface of the toner particle forms the sea-island structure of an incompatible resin (the polyester resin and the styrene (meth)acrylic resin), and the surface of the toner particle is exposed to the styrene (meth)acrylic resin within the above range, when the toner particles contact each other, the number of contact points of the same resin is reduced, and the non-electrostatic adhesive force of the toner is reduced.

On the other hand, Expression of the carrier: fluidity×bulk density is the carrier granularity rate per unit volume. When the value of Expression of the carrier: fluidity×bulk density is small, the specific gravity of carrier is large, or the surface irregularity of the carrier is large and thus the mechanical load becomes large. For this reason, when the value of the fluidity×bulk density is small, within the developing unit, the flow of the carrier is decreased, and the carrier accumulates in the stirring member or the layer regulating member, carrier replacement does not occur, and thereby a soft agglomerate is likely to be formed. When the value of Expression of the carrier: fluidity×bulk density is large, the fluidity of the carrier is extremely good, or the specific gravity of the carrier is small and thereby the ability to charge the toner is deteriorated. For this reason, when the value of fluidity×bulk density becomes large, the mechanical load to the toner is increased and the external additives become more susceptible to be embedded. As a result, the electrostatic adhesive force of the toner is enhanced, and thereby the soft agglomerate is likely to be formed. When the fluidity of the carrier is extremely good, there is a phenomenon (packing) in which the developer approaches the closest packing within the developing unit, the carrier slips and is hard to be stirred at the time of stirring by using a stirring member. With this, the carrier replacement does not occur, and thereby the soft agglomerate is likely to be formed.

On the other hand, when the value of Expression of the carrier: fluidity×bulk density is set in the above range, the above phenomenon is prevented and the occurrence of the soft agglomerate is prevented. As a result, the hard agglomerate is prevented from being formed.

From the above description, the image developer according to the exemplary embodiment is presumed that in the toner reclaim type image forming apparatus, the image formation with low image density is repeatedly performed, then the image formation is repeatedly performed on both sides of the recording medium, and the next day, the streaky image defects that occur when an image is formed with high image density are prevented.

Hereinafter, the image developer according to the exemplary embodiment will be described in detail.

The image developer according to the exemplary embodiment includes toner particles, and external additives which are externally added to the toner particles.

Toner Particles

The toner particles include a binder resin. The toner particles may include a coloring agent, a release agent, and other additives.

Binder Resin

As the binder resin, a polyester resin and a styrene (meth)acrylic resin are applied. The binder resin may include other binder resins in addition to the polyester resin and the styrene (meth)acrylic resin.

Polyester Resin

Examples of the polyester resin include a well-known polyester resin.

Examples of the polyester resin condensation polymers of polyvalent carboxylic acids and polyol. A commercially available product or a synthesized product may be used as the polyester resin.

Examples of the polyvalent carboxylic acid include aliphatic dicarboxylic acid (for example, oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acid (for example, cyclohexane dicarboxylic acid), aromatic dicarboxylic acid (for example, terephthalic acid, isophthalic acid, phthalic acid, and naphthalene dicarboxylic acid), an anhydride thereof, or lower alkyl esters (having, for example, from 1 to 5 carbon atoms) thereof. Among these, for example, aromatic dicarboxylic acids are preferably used as the polyvalent carboxylic acid.

As the polyvalent carboxylic acid, tri- or higher-valent carboxylic acid employing a crosslinked structure or a branched structure may be used in combination together with dicarboxylic acid. Examples of the tri- or higher-valent carboxylic acid include trimellitic acid, pyromellitic acid, anhydrides thereof, or lower alkyl esters (having, for example, 1 to 5 carbon atoms) thereof.

The polyvalent carboxylic acids may be used singly or in combination of two or more kinds thereof.

Examples of the polyol include aliphatic diol (for example, ethylene glycol, diethylene glycol, triethylene glycol, propylene glycol, butanediol, hexanediol, and neopentyl glycol), alicyclic diol (for example, cyclohexanediol, cyclohexane dimethanol, and hydrogenated bisphenol A), aromatic diol (for example, an ethylene oxide adduct of bisphenol A, and a propylene oxide adduct of bisphenol A). Among these, for example, aromatic diols and alicyclic diols are preferably used, and aromatic diols are further preferably used as the polyol.

As the polyol, a tri- or higher-valent polyol employing a crosslinked structure or a branched structure may be used in combination together with diol. Examples of the tri- or higher-valent polyol include glycerin, trimethylolpropane, and pentaerythritol.

The polyol may be used singly or in combination of two or more kinds thereof.

The glass transition temperature (Tg) of the polyester resin is preferably from 50° C. to 80° C., and further preferably from 50° C. to 65° C.

The glass transition temperature is obtained from a DSC curve obtained by differential scanning calorimetry (DSC). More specifically, the glass transition temperature is obtained from "extrapolated glass transition onset temperature" described in the method of obtaining a glass transition temperature in JIS K 7121-1987 "testing methods for transition temperatures of plastics".

The weight average molecular weight (Mw) of the polyester resin is preferably from 5,000 to 1,000,000, and is further preferably from 7,000 to 500,000.

The number average molecular weight (Mn) of the polyester resin is preferably from 2,000 to 100,000.

The molecular weight distribution Mw/Mn of the polyester resin is preferably from 1.5 to 100, and is further preferably from 2 to 60.

The weight average molecular weight and the number average molecular weight are measured by gel permeation chromatography (GPC). The molecular weight measurement by GPC is performed using GPC-HLC-8120 GPC, manufactured by Tosoh Corporation as a measuring device, Column TSK gel Super HM-M (15 cm), manufactured by Tosoh Corporation, and a THF solvent. The weight average molecular weight and the number average molecular weight are calculated by using a molecular weight calibration curve plotted from a monodisperse polystyrene standard sample from the results of the foregoing measurement.

A known preparing method is used to prepare the polyester resin. Specific examples thereof include a method of conducting a reaction at a polymerization temperature set to be from 180° C. to 230° C., if necessary, under reduced pressure in the reaction system, while removing water or an alcohol generated during condensation.

In a case where of the raw materials are not dissolved or compatibilized under a reaction temperature, a high-boiling-point solvent may be added as a solubilizing agent to dissolve the monomers. In this case, a polycondensation reaction is conducted while distilling away the solubilizing agent. In a case where a monomer having poor compatibility is present, the monomer having poor compatibility and an acid or an alcohol to be polycondensed with the monomer may be previously condensed and then polycondensed with the major component.

Styrene (Meth)Acrylic Resin

The styrene (meth)acrylic resin is a copolymer obtained by copolymerizing at least a monomer having a styrene skeleton and a monomer having a (meth)acryloyl group. Here, "(meth)acrylic acid" is an expression including both "acrylic acid" and "methacrylic acid". In addition, "(meth) acryloyl group" is an expression including both "acryloyl group" and "methacryloyl group".

Examples of the monomer having a styrene skeleton (hereinafter, referred to as a "styrene monomer") include styrene, alkyl-substituted styrene (for example, α-methylstyrene, 2-methylstyrene, 3-methylstyrene, 4-methylstyrene, 2-ethylstyrene, 3-ethylstyrene, 4-ethylstyrene), halogen-substituted styrene (for example, 2-chlorostyrene, 3-chlorostyrene, and 4-chlorostyrene), and vinylnaphthalene. The styrene monomer may be used singly or in combination of two or more kinds thereof.

Among them, as the styrene monomer, styrene is preferable from the viewpoint of ease of reaction, easiness of reaction control, and availability.

Examples a monomer having a (meth)acryloyl group (hereinafter, referred to as a "(meth)acrylic monomer") (meth)acrylic acid and (meth)acrylic acid ester. Examples of (meth)acrylic acid ester include (meth)acrylic acid alkyl ester (for example, n-methyl (meth)acrylate, n-ethyl (meth) acrylate, n-propyl (meth)acrylate, n-butyl (meth)acrylate, n-pentyl (meth)acrylate, n-hexyl (meth)acrylate, n-heptyl (meth)acrylate, n-octyl (meth)acrylate, n-decyl (meth)acrylate, n-dodecyl (meth)acrylate, n-lauryl (meth)acrylate, n-tetradecyl (meth)acrylate, n-hexadecyl (meth)acrylate, n-octadecyl (meth)acrylate, isopropyl (meth)acrylate, isobutyl (meth)acrylate, t-butyl (meth)acrylate, isopentyl (meth) acrylate, amyl (meth)acrylate, neopentyl (meth)acrylate, isohexyl (meth)acrylate, isoheptyl (meth)acrylate, isooctyl (meth)acrylate, 2-ethylhexyl (meth)acrylate, cyclohexyl (meth)acrylate, and t-butylcyclohexyl (meth)acrylate), (meth)acrylic acid aryl ester (for example, phenyl (meth) acrylate, biphenyl (meth)acrylate, diphenylethyl (meth) acrylate, t-butylphenyl (meth)acrylate, and terphenyl (meth) acrylate), dimethylaminoethyl (meth)acrylate, diethylaminoethyl (meth)acrylate, methoxyethyl (meth) acrylate, 2-hydroxyethyl (meth)acrylate, β-carboxyethyl (meth)acrylate, and (meth) acrylamide. The (meth)acrylic acid monomer may be used singly or in combination of two or more kinds thereof.

The styrene ratio of the styrene (meth)acrylic resin is preferably from 60% or about 60% by weight to 90% or about 90% by weight, is further preferably from 70% by weight to 90% by weight, and is still further preferably from 75% by weight to 90% by weight from the viewpoint of preventing the streaky image defects.

Particularly, with the large styrene ratio within the range of the styrene (meth)acrylic resin, when the external additives are applied to the oil-treated silica particles, the affinity with the oil liberated from the oil-treated silica particles is enhanced. For this reason, when the oil-treated silica particles are applied as the external additives, the oil adheres locally to the island portion interspersed in the surface of the toner particle, which makes it easier to prevent the toner particles from being aggregated. Therefore, the occurrence of the streaky image defects is likely to be prevented.

The styrene ratio is the weight ratio of styrene to all monomers for synthesizing styrene (meth)acrylic resin.

The styrene (meth)acrylic resin may have a crosslinked structure. Examples of the styrene (meth)acrylic resin having the crosslinked structure include a crosslinked product obtained by copolymerizing at least of a monomer having a styrene skeleton, a monomer having (meth)acrylic acid skeleton, and a crosslinkable monomer.

Examples of the crosslinkable monomer include a bifunctional or higher functional crosslinking agent. Examples of the bifunctional crosslinking agent include divinyl benzene, divinyl naphthalene, and a di(meth)acrylate compound (for example, diethylene glycol di(meth)acrylate, methylene bis (meth)acrylamide, decanediol diacrylate, and glycidyl (meth)acrylate), polyester type di(meth)acrylate, and 2-([1'-methyl propyl ideneamino]carboxyamino) ethyl methacrylate.

Examples of the multifunctional crosslinking agent include a tri(meth)acrylate compound (for example, pentaerythritol tri(meth)acrylate, trimethylol ethane tri(meth) acrylate, and trimethylol propane tri(meth)acrylate), a tetra (meth)acrylate compound (for example, tetramethylolmethane tetra(meth)acrylate, and oligoester (meth)acrylate), 2,2-bis(4-methacryloxy, polyethoxy phenyl) propane, diallyl phthalate, triallyl cyanurate, triallyl isocyanurate, triallyl trimellitate, and diaryl chloridate.

The copolymerization ratio (weight basis, crosslinkable monomer/entire monomers) of the crosslinkable monomer to the entire monomers may be from 2/1,000 to 30/1,000, for example.

The weight average molecular weight of the styrene (meth)acrylic resin may be, for example, from 30,000 to 200,000, is preferably from 40,000 to 100,000, and is further preferably from 50,000 to 80,000.

The weight average molecular weight of the styrene (meth)acrylic resin is measured by using the same method as that used for measuring the weight average molecular weight of the polyester resin.

Here, a total ratio of the polyester resin and the styrene (meth)acrylic resin to the entire binder resins may be, for example, 85% by weight or more, is preferably 95% by weight or more, and is further preferably 100% by weight.

In addition, the weight ratio (polyester resin/styrene (meth)acrylic resin) of the polyester resin to the styrene (meth)acrylic resin is preferably from 100/125 to 100/6, is further preferably from 100/50 or about 100/50 to 100/6 or about 100/6, and is still further preferably 100/30 to 100/6 from the viewpoint of preventing the streaky image defects.

Further, the content of the polyester resin with respect to the toner particles is preferably from 35% by weight to 90% by weight, is further preferably from 60% by weight to 85% by weight, and is still further preferably from 70% by weight to 85% by weight from the viewpoint of preventing the streaky image defects.

On the other hand, the content of the styrene (meth)acrylic resin with respect to the toner particles is preferably from 5% by weight to 50% by weight, is further preferably from 5% by weight to 30% by weight, and is still further 5% by weight to 25% by weight from the viewpoint of preventing the streaky image defects.

Other Binder Resins

Examples of other binder resins include a homopolymer of the monomers such as styrenes (for example, styrene, parachlorostyrene, and α-methylstyrene), (meth)acrylic esters (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenically unsaturated nitriles (for example, acrylonitrile and methacrylonitrile), vinyl ethers (for example, vinyl methyl ether and vinyl isobutyl ether), vinyl ketones (vinyl methyl ketone, vinyl ethyl ketone, vinyl isopropenyl ketone), and olefins (for example, ethylene, propylene, and butadiene), or a vinyl resin composed of a copolymer obtained by combining two or more kinds of these monomers (here, a vinyl resin except for the styrene (meth)acrylic resin).

As for other binder resins, examples of the binder resin include a non-vinyl resin such as an epoxy resin, a polyurethane resin, a polyamide resin, a cellulose resin, a polyether resin, and modified rosin, and a mixture with the above vinyl resin.

These binder resins may be used singly or in combination of two or more kinds thereof.

The content of the binder resin is, for example, preferably from 40% by weight to 95% by weight, is further preferably from 50% by weight to 90% by weight, and is still further preferably from 60% by weight to 85% by weight with respect to the entire toner particles.

Coloring Agent

Examples of the coloring agent include various kinds of pigments such as Carbon Black, Chrome Yellow, Hansa Yellow, Benzidine Yellow, Threne Yellow, Quinoline Yellow, Pigment Yellow, Permanent Orange GTR, Pyrazolone Orange, Vulcan Orange, Watch Young Red, Permanent Red, Brilliant Carmine 3B, Brilliant Carmine 6B, Dupont Oil Red, Pyrazolone Red, Lithol Red, Rhodamine B Lake, Lake Red C, Pigment Red, Rose Bengal, Aniline Blue, Ultramarine Blue, Calco Oil Blue, Methylene Blue Chloride, Phthalocyanine Blue, Pigment Blue, Phthalocyanine Green, Malachite Green Oxalate or various kinds of dyes such as acridine dye, xanthene dye, azo dye, benzoquinone dye, azine dye, anthraquinone dye, thioindigo dye, dioxazine dye, thiazine dye, azomethine dye, indigo dye, phthalocyanine dye, aniline black dye, polymethine dye, triphenylmethane dye, diphenylmethane dye, and thiazole dye.

The coloring agents may be used singly or in combination of two or more kinds thereof.

The coloring agent may use a surface-treated coloring agent, if necessary, or may be used in combination with a dispersant. Further, plural kinds of coloring agents may be used in combination.

The content of the coloring agent is, for example, is preferably from 1% by weight to 30% by weight, and is further preferably from 3% by weight to 15% by weight with respect to the entire toner particles.

Release Agent

Examples of the release agent include hydrocarbon waxes; natural waxes such as carnauba wax, rice wax, and candelilla wax; synthetic or mineral/petroleum waxes such as montan wax; and ester waxes such as fatty acid esters and montanic acid esters. However, the release agent is not limited to the above examples.

The melting temperature of the release agent is preferably from 50° C. to 110° C., and is further preferably from 60° C. to 100° C.

Note that, the melting temperature is obtained from a DSC curve obtained by differential scanning calorimetry (DSC), and specifically obtained from "melting peak temperature" described in the method of obtaining a melting temperature in JIS K 7121-1987 "testing methods for transition temperatures of plastics".

The content of the release agent is, for example, preferably from 1% by weight to 20% by weight, and is further preferably from 5% by weight to 15% by weight with respect to the entire toner particles.

Other Additives

Examples of other additives include well-known additives such as a magnetic material, a charge-controlling agent, and an inorganic powder. These additives are contained in the toner particle as internal additives.

Properties of Toner Particles

The toner particles form a sea-island structure which includes a sea portion containing a polyester resin and an island portion containing a styrene (meth)acrylic resin on a surface of the toner particle, and has an exposure rate of the styrene (meth)acrylic resin (the exposure rate of styrene (meth)acrylic resin on the surface of toner particle) in a range of from 5 atom % to 20 atom %.

The sea-island structure means a structure in which the sea portion containing a polyester resin is set as a continuous phase, and the island portion containing a styrene (meth) acrylic resin is dispersed as a dispersed phase.

Note that, the island portion may contain a styrene (meth) acrylic resin and other components (a release agent and the like). In addition, the island portion may include an island portion containing only a styrene (meth)acrylic resin, and an island portion containing only other components (a release agent and the like).

Here, in the surface of the toner particle, the present and absence of the sea-island structure may be determined by the following method.

The toner is dyed with ruthenium tetroxide for 3 hours in a desiccator at 30° C. Then, a toner SEM image which is dyed by using an ultra-high resolution field emission scanning electron microscope (FE-SEM, S-4800 manufactured by Hitachi High-Technologies Corporation) is obtained. Since it is likely that the release agent, the styrene (meth) acrylic resin, and the polyester resin tend to be sequentially dyed with ruthenium tetroxide, each component is identified with the shading caused by a degree of dyeing so as to confirm the presence and absence of the sea-island structure. Note that, in a case where it is hard to determine the shading, the time for dyeing is adjusted.

30 surfaces of the toner particles are selected, the maximum length of the domain diameter of the island portion of the dyed styrene (meth)acrylic resin is measured, the measured maximum length is assumed as a domain diameter, and an arithmetic mean diameter thereof is determined as a domain diameter of the island portion. In a case where the toner contains the external additives, the measurement is performed by using toner samples which are obtained by removing the external additives through an ultrasonic treatment at 40° C. after 50 ml of 0.2% surfactant aqueous solution is added and mixed to 2 g of toner, and then drying and collecting the resultant. In addition, the ultrasonic treatment is continuously performed until the toughness of the element due to the external additives is stabilized by using an X-ray photoelectron spectroscopy (XPS) described below. In a case of using a surfactant, the toner is washed until the surfactant is removed and then collecting the resultant.

Here, on the surface of the toner particle, the exposure rate of the styrene (meth)acrylic resin is from 5 atom % or about 5 atom % to 20 atom % or about 20 atom %, but is preferably from 7 atom % to 20 atom %, and is further preferably from 10 atom % or about 10 atom % to 20 atom % or about 20 atom % from the viewpoint of preventing the streaky image defects. Further, the domain diameter of the island portion of the styrene (meth)acrylic resin on the surface of the toner particle is preferably from 0.1 μm or about 0.1 μm to 0.6 μm or about 0.6 μm, and is further preferably from 0.3 μm or about 0.3 μm to 0.5 μm or about 0.5 μm.

The exposure rate of the styrene (meth)acrylic resin is a value obtained by the XPS measurement. Specifically, in the XPS measurement, JPS-9000MX manufactured by JEOL Ltd. is used as a measurement device, and the measurement is performed by using an MgKα ray as the X-ray source and setting an accelerating voltage to 10 kV and an emission current to 30 mA.

The styrene (meth)acrylic resin on the surface of the toner particle is determined by peak separation of a component derived from the styrene (meth)acrylic resin on the surface of the toner particle, from the obtained C1S spectrum obtained under the conditions described above. In the peak separation, the measured spectrum is separated into each component using curve fitting by the least square method. As the component spectrum to be the base of the peak separation, a C1S spectrum obtained by singly measuring other components such as a styrene (meth)acrylic resin and a polyester resin which are used for preparing the toner particles is used.

Note that, in a case where the toner contains the external additives, 50 ml of 0.2% surfactant aqueous solution is added to 2 g of toner, the mixture is stirred, then the external additives are removed by performing an ultrasonic treatment at 40° C., then the remainder is dried, and collected to form a toner sample, and the obtained toner sample is used for the measurement. In addition, the ultrasonic treatment is continuously performed until the toughness of the element due to the external additives is stabilized by using the above XPS. In a case of using a surfactant, washing is performed until the surfactant is removed and then collecting the resultant.

The toner particles may be toner particles having a single-layer structure, or toner particles having a so-called core-shell structure composed of a core (core) and a coating layer (shell layer) coated on the core, but is preferably toner particles having the core-shell structure. Here, from the viewpoint that the exposure rate of the styrene (meth)acrylic resin is within the above range, the toner particles having the core shell structure may be composed of, for example, a core containing a binder resin, and if necessary, other additives such as a coloring agent and, and a coating layer containing a polyester resin and a styrene (meth)acrylic resin as a binder resin.

The thickness of the coating layer is preferably from 5% to 30%, and is further preferably from 5% to 15% with respect to the volume average particle diameter of the toner particles. The thickness of the coating layer is measured by using the following method. The toner is embedded with an epoxy resin or the like and cut with a diamond knife or the like to prepare a thin slice. The thin slice is observed by using a transmission electron microscope (TEM) or the like, and cross sectional images of plural toner particles are imaged. The thickness of the coating layer is measured from 20 cross-sectional images of the toner particles and an average value thereof is adopted. Note that, the toner particles are measured by taking out the toners having a toner cross-sectional diameter of not less than 80% with respect to the volume average particle diameter of the toner. In addition, in a case where it is difficult to observe the coating layer in the cross-sectional image, in order to facilitate the measurement, the coating layer may be dyed to be observed.

In addition, from the viewpoint that the exposure rate of the styrene (meth)acrylic resin is within the above range, the domain diameter of the styrene (meth)acrylic resin in the toner particles is preferably from 0.3 μm or about 0.3 μm to 1.5 μm or about 1.5 μm, and is further from 0.4 μm or about 0.4 μm to 1.0 μm or about 1.0 μm.

The domain diameter of the styrene (meth)acrylic resin in the toner particles may be measured by the following method. The toner is mixed and embedded in an epoxy resin, and the epoxy resin is solidified. The obtained solid is cut by using an ultramicrotome device (Ultracut UCT manufactured by Leica) so as to prepare a thin sample having a thickness in a range of from 80 nm to 130 nm. A toner cross section SEM image is obtained by using the same method as that used for in the case of the island portion domain diameter of the styrene (meth)acrylic resin on the toner surface. In the SEM image, 30 toner cross sections having a maximum length which is 60% or more of the toner particle are selected and 100 domains of the dyed styrene (meth) acrylic resin are observed. The maximum length of each cross section is measured, the measured maximum length is regarded as the maximum domain diameter, and the arithmetic mean thereof is set as an average diameter.

The volume average particle diameter (D50v) of the toner particles is preferably from 2 μm to 10 μm, and is further preferably from 4 μm to 8 μm.

Various average particle diameters and various particle diameter distribution indices of the toner particles are measured using a CoulterMultisizer II (manufactured by Beckman Coulter, Inc.) and ISOTON-II (manufactured by Beckman Coulter, Inc.) as an electrolyte.

In the measurement, from 0.5 mg to 50 mg of a measurement sample is added to 2 ml of a 5% aqueous solution of a surfactant (preferably, sodium alkylbenzene sulfonate) as a dispersant. The obtained material is added to 100 ml to 150 ml of the electrolyte.

The electrolyte in which the sample is suspended is subjected to a dispersion treatment using an ultrasonic disperser for 1 minute, and a particle diameter distribution of particles having a particle diameter of from 2 μm to 60 μm is measured by a Coulter Multisizer II using an aperture having an aperture diameter of 100 μm. 50,000 particles are sampled.

Cumulative distributions by volume and by number are drawn from the side of the smallest diameter with respect to particle diameter ranges (channels) separated based on the measured particle diameter distribution. The particle diameter when the cumulative percentage becomes 16% is identified as that corresponding to a volume average particle diameter D16v and a number average particle diameter D16p, while the particle diameter when the cumulative percentage becomes 50% is identified as that corresponding to a volume average particle diameter D50v and a number average particle diameter D50p. Furthermore, the particle diameter when the cumulative percentage becomes 84% is identified as that corresponding to a volume average particle diameter D84v and a number average particle diameter D84p.

Using these, a volume average particle diameter distribution index (GSDv) is calculated as $(D84v/D16v)^{1/2}$, while a number average particle diameter distribution index (GSDp) is calculated as $(D84p/D16p)^{1/2}$.

The average circularity of the toner particles is preferably from 0.94 to 1.00, and is preferably from 0.95 to 0.98.

The average circularity of the toner particles is calculated by (circumference length of circle equivalent diameter)/(circumference length) [(circumference length of circle having the same projection area as that of particle image)/(circumference length of particle projected image)]. Specifically, the value is measured by using the following method.

The average circularity of the toner particles is calculated by using a flow particle image analyzer (measured by FPIA-3000 manufactured by Sysmex Corporation) which first, suctions and collects the toner particles to be measured so as to form a flat flow, then captures a particle image as a static image by instantaneously emitting strobe light, and then performs image analysis of the obtained particle image. 4,500 particles are sampled at the time of calculating the average circularity.

External Additives

Examples of the external additives include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)n$, $Al_2O_3.2SiO_2$, $CaCO_3$, $MgCO_3$, $BaSO_4$, and $MgSO_4$.

Surfaces of the inorganic particles as an external additive may be treated with a hydrophobizing agent. The hydrophobizing treatment is performed by, for example, dipping the inorganic particles in a hydrophobizing agent. The hydrophobizing agent is not particularly limited and examples thereof include a silane coupling agent, silicone oil, a titanate coupling agent, and an aluminum coupling agent. These may be used alone or in combination of two or more kinds thereof.

Generally, the amount of the hydrophobizing agent is, for example, from 1 part by weight to 10 parts by weight with respect to 100 parts by weight of the inorganic particles.

Examples of the external additive include a resin particle (resin particle such as polystyrene, polymethyl methacrylate (PMMA), and melamine resin), a cleaning aid (for example, metal salts of higher fatty acids typified by zinc stearate, and particles having fluorine high molecular weight polymer).

Among them, the external additives are required to be loosely adhered to the surface of the toner particle in order to reduce the toner cohesion, and from the viewpoint of the adhesion to the toner and the cohesion of the external additives, silica particles are preferable, and particularly, oil-treated silica particles are preferable. The oil-treated silica particles mean silica particles which are surface-treated by oil. The volume average particle diameter of the oil-treated silica particles is preferably from 50 nm or about 50 nm to 200 nm or about 200 nm, and is further preferably from 80 nm to 150 nm.

The oil liberated from the oil-treated silica particles has a property of high affinity for the styrene (meth)acrylic resin contained in the island portion having a polarity smaller than that of the polyester resin contained in the sea portion in the sea-island structure, and has a property of being easily shifted. For this reason, when the oil-treated silica particles are applied as the external additives, the oil adheres locally to the island portion interspersed in the surface of the toner particle, which makes it easier to prevent the toner particles from being aggregated. For this reason, it is likely to prevent the streaky image defects from occurring.

The specific silica particles which are targets of the oil treatment are particles containing silica (that is, $SiO_2$) as a major component, and may be crystalline or non-crystalline. The silica particles may be particles prepared by using a silicon compound such as water glass and alkoxysilane as a raw material, or may be particles obtained by pulverizing quartz.

Specifically, examples of the specific silica particles include sol-gel silica particles, aqueous colloidal silica particles, alcoholic silica particles, fumed silica particles obtained by using a gas-phase method, and molten silica particles.

As the oil used in the surface treatment for the silica particles, one or more compounds selected from lubricating oils and fats and oils. Examples of the oil include silicone oil, paraffin oil, fluorine oil, and vegetable oil. The oils may be used alone, or in combination of two or more kinds thereof.

Examples of the silicone oil include dimethyl silicone oil, methyl phenyl silicone oil, chlorophenyl silicone oil, methyl hydrogen silicone oil, alkyl modified silicone oil, fluorine modified silicone oil, polyether modified silicone oil, Alcohol modified silicone oil, amino modified silicone oil, epoxy modified silicone oil, epoxy polyether modified silicone oil, phenol modified silicone oil, carboxyl modified silicone oil, mercapto modified silicone oil, acryl or methacryl modified silicone oil, and α-methylstyrene-modified silicone oil.

Examples of the paraffin oil include liquid paraffin.

Examples of the fluorine oil include fluorine oil and fluorinated oil.

Examples of the mineral oil include machine oil.

Examples of vegetable oil include rapeseed oil and palm oil.

Among the oils, from the viewpoint of preventing the occurrence of the streaky image defects, the silicone oil is preferable.

The amount of the liberated oil of the oil-treated silica particles is preferably from 3% or about 3% by weight to 15% or about 15% by weight, and is further preferably from 5% by weight to 10% by weight from the viewpoint of preventing the occurrence of the streaky image defects.

The amount of the liberated oil is the ratio of the amount of the liberated oil with respect to the entire oil-treated silica particles. In addition, the amount of the liberated oil is a value measured by the method described in the following description.

A proton NMR measurement is performed on the oil-treated silica particles by using AL-400 (magnetic field 9.4 T (H nucleus 400 MHz)) manufactured by JEOL Ltd. A zirconia sample tube (diameter 5 mm) is filled with a sample, a deuterated chloroform solvent, and TMS as reference material. This sample tube is set, and the measurement is performed with the conditions of frequency: Δ87 kHz/400 MHz (=Δ20 ppm), measuring temperature: 25° C., accumulation count: 16 times, and resolution: 0.24 Hz (32000 point), and then the amount of the liberated oil is converted from the peak intensity due to the liberated oil by using a calibration curve.

For example, in a case where the dimethyl silicone oil is used as oil, an NMR measurement of untreated silica particles and the dimethyl silicone oil (amount at 5 level) is perform, and a calibration curve of the amount of the liberated oil and the NMR peak intensity is prepared. Then, the amount of the liberated oil is calculated by using the calibration curve.

Here, the volume average particle diameter of the external additives (particularly, oil-treated silica particles) is measured by the following method.

100 primary particles of external additives are observed with a scanning electron microscope (SEM) apparatus. Next, the longest diameter and the shortest diameter of each particle are measured by image analysis of primary particles, and the sphere equivalent diameter is measured from this intermediate value. A 50% diameter (D50 v) in the cumulative frequency on the basis of volume of the obtained sphere equivalent diameter is set as the volume average particle diameter of the external additives.

The amount of the external additive is, for example, preferably from 0.01 weight % to 5 weight %, and is further preferably from 0.01 weight % to 2.0 weight % with respect to the toner particles.

Preparing Method of Toner

Next, the method of preparing the toner will be described.

The toner of the exemplary embodiment is obtained by additionally adding the external additive to the toner particles after preparing the toner particles.

The toner particles may be prepared by using any one of a drying method (for example, a kneading and pulverizing method) and a wetting method (for example, an aggregation and coalescence method, a suspension polymerization method, and a dissolution suspension method). The preparing method of the toner particles is not particularly limited, and well-known method may be employed.

Among them, the toner particles may be obtained by using the aggregation and coalescence method.

Specifically, for example, in a case where the toner particles are prepared by using the aggregation and coalescence method, the toner particles are prepared through the following steps.

The steps include a step (a resin particle dispersion preparing step) of preparing a resin particle dispersion in which resin particles constituting the binder resin are dispersed and a coloring agent particle dispersion in which particles of the coloring agent containing a white pigment (hereinafter, also referred to as "a coloring agent particle") are dispersed, a step (an aggregated particle forming step) of forming aggregated particles by aggregating the resin particles and coloring agent particles (other particles if necessary), in the dispersion in which the resin particle dispersion and the coloring agent particle dispersion are mixed with each other (in the dispersion in which other particle dispersions are mixed, if necessary); and a step (a coalescence step) of coalescing aggregated particles by heating an aggregated particle dispersion in which aggregated particles are dispersed so as to form toner particles.

Hereinafter, the respective steps will be described in detail.

In the following description, a method of obtaining toner particles including the coloring agent and the release agent will be described; however, the coloring agent and the release agent are used if necessary. Other external additives other than the coloring agent and the release agent may also be used.

Resin particle dispersion preparing step First, a resin particle dispersion in which the resin particles corresponds to the binder resins containing the crystalline polyester resin are dispersed, a coloring agent particle dispersion in which coloring agent particles are dispersed, and a release agent particle dispersion in which the release agent particles are dispersed are prepared, for example.

Here, the resin particle dispersion is, for example, prepared by dispersing the resin particles in a dispersion medium with a surfactant.

An aqueous medium is used, for example, as the dispersion medium used in the resin particle dispersion.

Examples of the aqueous medium include water such as distilled water, ion exchange water, or the like, alcohols, and the like. The medium may be used singly or in combination of two or more kinds thereof.

Examples of the surfactant include anionic surfactants such as sulfate, sulfonate, phosphate, and soap anionic surfactants; cationic surfactants such as amine salt and quaternary ammonium salt cationic surfactants; and nonionic surfactants such as polyethylene glycol, alkyl phenol ethylene oxide adduct, and polyol. Among them, anionic surfactants and cationic surfactants are particularly preferable. Nonionic surfactants may be used in combination with anionic surfactants or cationic surfactants.

The surfactants may be used singly or in combination of two or more kinds thereof.

Regarding the resin particle dispersion, as a method of dispersing the resin particles in the dispersion medium, a common dispersing method using, for example, a rotary shearing-type homogenizer, or a ball mill, a sand mill, or a Dyno mill as media is exemplified. Depending on the type of the resin particles, the resin particles may be dispersed in the resin particle dispersion using, for example, a phase inversion emulsification method.

The phase inversion emulsification method includes: dissolving a resin to be dispersed in a hydrophobic organic solvent in which the resin is soluble; conducting neutralization by adding a base to an organic continuous phase (O phase); and converting the resin (so-called phase inversion) from W/O to O/W by adding an aqueous medium (W phase) to form a discontinuous phase, thereby dispersing the resin as particles in the aqueous medium.

The volume average particle diameter of the resin particles dispersed in the resin particle dispersion is, for example, preferably from 0.01 μm to 1 μm, further preferably from 0.08 μm to 0.8 μm, and still further preferably from 0.1 μm to 0.6 μm.

Regarding the volume average particle diameter of the resin particles, a cumulative distribution by volume is drawn from the side of the smallest diameter with respect to particle diameter ranges (channels) separated using the particle diameter distribution obtained by the measurement of a laser diffraction-type particle diameter distribution measuring device (for example, manufactured by Horiba, Ltd., LA-700), and a particle diameter when the cumulative percentage becomes 50% with respect to the entire particles is measured as a volume average particle diameter D50v. The volume average particle diameter of the particles in other dispersions is also measured in the same manner.

The content of the resin particles contained in the resin particle dispersion is, for example, preferably from 5% by weight to 50% by weight, and further preferably from 10% by weight to 40% by weight.

For example, the coloring agent particle dispersion and the release agent particle dispersion are also prepared in the same manner as in the case of the resin particle dispersion. That is, the resin particles in the resin particle dispersion are the same as the coloring agent particles dispersed in the coloring agent particle dispersion, and the release agent particles dispersed in the release agent particle dispersion, in terms of the volume average particle diameter, the dispersion medium, the dispersing method, and the content of the particles.

Aggregated Particle Forming Step

Next, the resin particle dispersion, the coloring agent dispersion, and the release agent particle dispersion are mixed with each other.

The resin particles, the coloring agent particles, and the release agent particle are heterogeneously aggregated in the mixed dispersion, thereby forming aggregated particles having a diameter near a target toner particle diameter and including the resin particles, the coloring agent particles, and the release agent particles.

Specifically, for example, an aggregating agent is added to the mixed dispersion and a pH of the mixed dispersion is adjusted to be acidic (for example, the pH is from 2 to 5). If necessary, a dispersion stabilizer is added. Then, the mixed dispersion is heated at a temperature of a glass transition temperature of the resin particles (specifically, for example, in a range of from glass transition temperature of −30° C. to glass transition temperature of −10° C. of the resin particles) to aggregate the particles dispersed in the mixed dispersion, thereby forming the aggregated particles.

In the aggregated particle forming step, for example, the aggregating agent may be added at room temperature (for example, 25° C.) while stirring of the mixed dispersion using a rotary shearing-type homogenizer, the pH of the mixed dispersion may be adjusted to be acidic (for example, the pH is from 2 to 5), a dispersion stabilizer may be added if necessary, and then the heating may be performed.

Examples of the aggregating agent include a surfactant having an opposite polarity to the polarity of the surfactant used as the dispersant to be added to the mixed dispersion, an inorganic metal salt, a divalent or more metal complex. Particularly, when a metal complex is used as the aggregating agent, the amount of the surfactant used is reduced and charging characteristics are improved.

An additive for forming a bond of metal ions as the aggregating agent and a complex or a similar bond may be used, if necessary. A chelating agent is suitably used as this additive.

Examples of the inorganic metal salt include metal salt such as calcium chloride, calcium nitrate, barium chloride, magnesium chloride, zinc chloride, aluminum chloride, and aluminum sulfate, and an inorganic metal salt polymer such as poly aluminum chloride, poly aluminum hydroxide, and calcium polysulfide.

As the chelating agent, an aqueous chelating agent may be used. Examples of the chelating agent include oxycarboxylic acid such as tartaric acid, citric acid, and gluconic acid, iminodiacetic acid (IDA), nitrilotriacetic acid (NTA), and ethylenediaminetetraacetic acid (EDTA).

The additive amount of the chelating agent is, for example, preferably from 0.01 parts by weight to 5.0 parts by weight, and is further preferably 0.1 parts by weight or more and less than 3.0 parts by weight, with respect to 100 parts by weight of resin particle.

Coalescence Step

Next, the aggregated particle dispersion in which the aggregated particles are dispersed is heated at, for example, a temperature that is equal to or higher than the glass transition temperature of the resin particles (for example, a temperature that is higher than the glass transition temperature of the resin particles by 10° C. to 30° C.) to perform the coalesce on the aggregated particles and form toner particles.

The toner particles are obtained through the foregoing steps.

Note that, the toner particles may be prepared through a step of forming second aggregated particles in such a manner that an aggregated particle dispersion in which the aggregated particles are dispersed is obtained, then the aggregated particle dispersion and a resin particle dispersion in which the resin particles are dispersed are mixed, and aggregated such that the resin particles are further adhered on the surface of the aggregated particle; and a step of forming the toner particles having a core/shell structure by heating a second aggregated particle dispersion in which the second aggregated particles are dispersed, and coalescing the second aggregated particles.

Here, as the "resin particle dispersion in which the resin particles are dispersed" for forming the second particles, a polyester resin particle dispersion in which the polyester resin particles are dispersed, and a styrene (meth)acrylic resin particle dispersion in which the styrene (meth)acrylic resin particles are dispersed are used. In addition, a mixed resin particle dispersion in which the polyester resin particles and the styrene (meth)acrylic resin particles are dispersed may be used.

Here, after the coalescence step ends, the toner particles formed in the solution are subjected to a washing step, a solid-liquid separation step, and a drying step, that are well known, and thus dry toner particles are obtained.

In the washing step, displacement washing using ion exchange water may be sufficiently performed from the viewpoint of charging properties. In addition, the solid-liquid separation step is not particularly limited, but suction filtration, pressure filtration, or the like is preferably performed from the viewpoint of productivity. The method of the drying step is also not particularly limited, but freeze drying, airflow drying, fluidized drying, vibration-type fluidized drying, or the like may be performed from the viewpoint of productivity.

The toner according to the exemplary embodiment is prepared by adding and mixing, for example, an external additive to the obtained dry toner particles. The mixing may be performed with, for example, a V-blender, a HENSCHEL MIXER, a LODIGE MIXER, or the like. Furthermore, if necessary, coarse particles of the toner may be removed by using a vibration sieving machine, a wind classifier, or the like.

Carrier

A carrier having a fluidity and a bulk density which satisfy Expression: 65.0≤fluidity×bulk density 72.5 under the environment of a temperature of 25° C. and a humidity of 50% is applied.

As the carrier, from the viewpoint of preventing the streaky image defects, a carrier having a fluidity and a bulk density which satisfy Expression: 65.0≤fluidity×bulk density≤70.0 is preferable, and a carrier having a fluidity and a bulk density which satisfy Expression: 66.0≤fluidity×bulk density≤67.5 is further preferable.

From the viewpoint of preventing the streaky image defects, the fluidity of the carrier is preferably from 25.0 sec/50 g to 40.0 sec/50 g, is further preferably from 25.0 sec/50 g to 37.5 sec/50 g, and is still further preferably from 30.0 sec/50 g to 35.0 sec/50 g under the environment of a temperature of 25° C. and a humidity of 50%.

The fluidity of the carrier may be controlled by adjusting an average interval Sm of the surface irregularity to 2.0 μm or less or about 2.0 μm or less, or a surface roughness Ra (based on JISB0601) to 0.1 μm or less or about 0.1 μm or less with respect to a core of a carrier (for example, core of ferrite).

Here, the fluidity of the carrier is a value measured based on JIS-Z2502 (2000) at 25° C. and 50RH %.

From the viewpoint of preventing the streaky image defects, the bulk density of the carrier is preferably from 1.5 $g/cm^3$ to 2.2 $g/cm^3$, is further preferably from 1.6 $g/cm^3$ to 2.1 $g/cm^3$, and is still further preferably from 1.8 $g/cm^3$ to 2.0 $g/cm^3$.

The bulk density of the carrier is controlled, for example, by setting the average roughness Ra of the surface irregularity of the carrier to from 0.20 μm or about 0.20 μm to 0.25 μm or about 0.25 μm.

Here, the bulk density of the carrier is a value measured by weighing 80 g of carrier with a bulk density measuring device (manufactured by Tsutsui Scientific Instruments Co., Ltd.) based on the JISZ2504 (2012).

The volume average particle diameter of the carrier (also, referred to as "D50") is preferably from 20 μm to 100 μm, is further preferably from 25 μm to 80 μm, and is still further preferably from 25 μm to 50 μm from the viewpoint of preventing the streaky image defects. Here, the volume average particle diameter of the carrier is a value measured by using a laser diffraction-type particle diameter distribution measuring device (for example, manufactured by Horiba, Ltd., LA-700). Specifically, a volume cumulative distribution is drawn from the side of the smallest diameter with respect to particle diameter ranges (channels) the particle diameter distribution obtained through the measuring device is divided, and then a particle diameter when the cumulative percentage becomes 50% is set as a volume average particle diameter.

The carrier is not particularly limited, and a well-known carrier may be used. Examples of the carrier include a coating carrier in which the surface of the core formed of magnetic particle is coated with the coating resin; a magnetic particle dispersion-type carrier in which the magnetic particle are dispersed and distributed in the matrix resin; and a resin impregnated-type carrier in which a resin is impregnated into the porous magnetic particles.

Note that, the magnetic particle dispersion-type carrier and the resin impregnated-type carrier may be a carrier in which the forming particle of the carrier is set as a core and the core is coated with the coating resin.

Examples of the magnetic particle include a magnetic metal such as iron, nickel, and cobalt, and a magnetic oxide such as ferrite, and magentite.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid ester copolymer, a straight silicone resin formed by containing an organosiloxane bond or a modified product thereof, a fluororesin, polyester, polycarbonate, a phenol resin, and an epoxy resin.

Note that, other additives such as the conductive particles and the resin particles may be contained in the coating resin and the matrix resin.

Examples of the conductive particles include particles of metal such as gold, silver, and copper, carbon black, titanium oxide, zinc oxide, tin oxide, barium sulfate, aluminum borate, and potassium titanate.

The resin particles are preferably contained in a coating resin layer of the carrier for the purpose of charge control.

Examples of the resin particles include thermoplastic resin particles and thermosetting resin particles.

Examples of thermoplastic resin particles specifically include particles of a polyolefin resin (such as polyethylene and polypropylene), a polyvinyl resin or a polyvinylidene resin (such as polystyrene, acrylic resin, polyacrylonitrile, polyvinyl acetate, polyvinyl alcohol, polyvinyl butyral, polyvinyl chloride, polyvinyl carbazole, polyvinyl ether, and polyvinyl ketone), a vinyl chloride-vinyl acetate copolymer, a styrene-acrylic acid copolymer, a straight silicone resin composed of an organosiloxane bond or a modified product thereof, a fluorine resin (polytetrafluoroethylene, polyvinyl fluoride, polyvinylidene fluoride, and polychlorotrifluoro ethylene), a polyester resin, and a polycarbonate resin.

Examples of the thermosetting resin particles include particles of a phenol resin, an amino resin (a urea-formaldehyde resin, a melamine resin, a benzoguanamine resin, a urea resin, and apolyamide resin), and an epoxy resin.

The thickness of the coating resin layer of the carrier is preferably from 0.1 μm to 5 μm, and is further preferably from 0.3 μm to 3 μm. When the thickness of the coating resin layer is smaller than 0.1 μm, it is difficult to form a uniform and flat coating resin layer on the surface of the core. On the other hand, when the thickness of the coating resin layer is larger than 5 μm, the carriers agglomerate with each other, and it is difficult to obtain a carrier that is nearly uniform.

In addition, in a case where the resin particles are dispersed in the coating resin layer, carrier charging sites are increased, so that the surface polarization of the carrier is prevented, and the charge applied to the toner becomes uniform, and thereby the toner aggregation is also prevented. Further, when the surface of the carrier is exposed to the resin particles, the filling property (packing property) of the carrier is lowered, and the mechanical load applied to the carrier is relaxed.

Here, in order to coat the surface of the core with the coating resin, a method of coating the surface with a coating layer forming solution in which the coating resin, and various external additives if necessary are dissolved in a proper solvent is used. The solvent is not particularly limited as long as a solvent is selected in consideration of a coating resin to be used and coating suitability.

Specific examples of the resin coating method include a dipping method of dipping the core into the coating layer forming solution, a spray method of spraying the coating layer forming solution onto the surface of the core, a fluid-bed method of spraying the coating layer forming solution to the core in a state of being floated by the fluid air, and a kneader coating method of mixing the core of the carrier with the coating layer forming solution and removing a solvent in the kneader coater.

The mixing ratio (weight ratio) of the toner to the carrier in the two-component developer is preferably from toner: carrier=1:100 to 30:100, and is further preferably from 3:100 to 20:100.

Image Forming Apparatus and Image Forming Method

An image forming apparatus according to the exemplary embodiment and an image forming method will be described below.

The image forming apparatus according to the exemplary embodiment includes an image holding member, a charging unit that charges a surface of the image holding member, an electrostatic charge image forming unit that forms an electrostatic charge image on the charged surface of the image holding member, a developing unit that accommodates an electrostatic charge image developer, and develops the electrostatic charge image formed on the surface of the image holding member with the electrostatic charge image developer to obtain a toner image, a transfer unit that transfers the toner image formed on the surface of the image holding member to the surface of a recording medium, a fixing unit that fixes the toner image transferred to the surface of the recording medium, a cleaning unit that removes a toner remaining on the surface of the image holding member, and a toner supply unit that supplies the removed toner to the developing unit. In addition, as an electrostatic charge image developer, the electrostatic charge image developer according to the exemplary embodiment is applied.

In the image forming apparatus according to the exemplary embodiment, an image forming method (the image forming method according to the exemplary embodiment) which includes a charging step of charging a surface of the image holding member, an electrostatic charge image forming step of forming an electrostatic charge image the charged surface of the image holding member, a developing step of developing an electrostatic charge image formed on the surface of the image holding member by the developing unit accommodating an electrostatic charge image developer according to the exemplary embodiment to obtain a toner image, a transfer step of transferring the toner image formed on the surface of the image holding member to a surface of a recording medium, a fixing step of fixing the toner image the transferred to the surface of the recording medium, a cleaning step of cleaning the toner remaining on the surface of the image holding member, and a supply step of supplying the removed toner to the developing unit is performed.

Here, the developing unit preferably includes a developer holding member that is disposed to face the surface of the image holding member and holds the electrostatic charge image developer on the surface, and a layer regulating member that regulates the layer thickness of the electrostatic charge image developer held by the developer holding member, and has a portion bent toward the developer holding member.

When the developer passes between the developer holding member and the layer regulating member, it is likely that the mechanical load is applied to the toner of the developer by a portion of the layer regulating member facing the developer holding member. In this regard, when the portion of the layer regulating member facing the developer holding member is bent, it is difficult to apply the mechanical load to the toner of the developer. With this, the external additives are prevented from being embedded into the surface of the toner particle. As a result, it is possible to prevent not only the occurrence of the soft agglomerate but also the occurrence of the hard agglomerate, and thereby the occurrence of the streaky image defects is likely to be controlled.

As the image forming apparatus according to the exemplary embodiment, well-known image forming apparatuses such as an apparatus including a direct-transfer type apparatus that directly transfers the toner image formed on the surface of the image holding member to the recording medium; an intermediate transfer type apparatus that primarily transfers the toner image formed on the surface of the image holding member to a surface of an intermediate transfer member, and secondarily transfers the toner image transferred to the intermediate transfer member to the surface of the recording medium; and an apparatus including an erasing unit that erases charges by irradiating the surface of the image holding member with erasing light before being charged and after transferring the toner image.

In a case where the intermediate transfer type apparatus is used, the transfer unit is configured to include an intermediate transfer member that transfers the toner image to the surface, a primary transfer unit that primarily transfers the toner image formed on the surface of the image holding member to the surface of the intermediate transfer member, and a secondary transfer unit the toner image formed on the surface of the intermediate transfer member is secondarily transferred to the surface of the recording medium.

In the image forming apparatus according to the exemplary embodiment, for example, a unit including the developing unit may be a cartridge structure (process cartridge) detachable from the image forming apparatus. As a process cartridge, for example, a process cartridge including the developing unit accommodating the electrostatic charge image developer in the exemplary embodiment is preferably used.

Hereinafter, an example of the image forming apparatus of the exemplary embodiment will be described; however, the invention is not limited thereto. Note that, in the drawing, major portions will be described, and others will not be described.

FIG. 1 is a configuration diagram illustrating an example of an image forming apparatus according to the exemplary embodiment.

An image forming apparatus 300 as illustrated in FIG. 1 includes a housing 200 having a rectangular parallelepiped shape, a paper container 204 that contains the recording paper (an example of the recording medium) P is provided on the downside in the housing 200. In addition, a drawing roller 92 which is disposed on one end side of an arm so as to draw the recording paper P contained in the paper container 204, a roller 94 disposed on the other end side, and a roller 96 which is disposed to face the roller 94.

In the image formation, the drawing roller 92 is moved downward in accordance with the position of the recording paper P contained the paper container 204, and the drawing roller 92 is rotated in a state of being in contact with the recording paper P on the uppermost layer, and thereby the recording paper P is drawn. The drawn recording paper P is transported to the rollers 94 and 96, and then is transported in a state of being nipped between a pair of rollers 82 on the downstream side of the roller 96 in the paper supply direction. Further, on the downstream side of the pair of rollers 82 in the supplying direction, a roller 84 and a roller 86 which are disposed to face each other, a roller 88 that changes the supplying direction of the recording paper P, and a pair of rollers 90 are provided in order.

Also, the image forming apparatus 300 is provided with a cylindrical photoreceptor (an example of the image holding member) 10 that is disposed on the upstream side in the housing 200, and rotates in the clockwise direction.

In the circumference of the photoreceptor 10, a charging roller (an example of the charging unit) 20, an exposure device (an examples of the electrostatic charge image forming unit) 30, a developing device (an example of the developing unit) 40, a transfer roller (an example of the transfer unit) 52, an erasing device (an example of the erasing unit) 60, and a cleaning device (an example of the cleaning unit) 70 are sequentially provided in the clockwise direction.

Specifically, in the circumference of the photoreceptor 10, a charging roller 20 that is provided to face the photoreceptor 10 and charges the surface of the photoreceptor 10 at a predetermined potential, an exposure device 30 that exposes the surface of the photoreceptor 10 charged by the charging roller 20 so as to form an electrostatic charge image, and a developing device 40 that develops the electrostatic charge image by supplying the toner charged to the electrostatic charge image are provided. Further, a transfer roller 52 that is provided to face the photoreceptor 10 and transfers the toner image to the recording paper P, an erasing device 60 that erases the charge by irradiating the surface of the photoreceptor 10 after transferring the toner image to the transfer roller 52 with erasing light, a cleaning device 70 that cleans the surface of the photoreceptor 10 so as to remove the remaining toner, and a supply feeding path 74 (an example of the toner supply unit) that supplies the removed toner (collected toner) to the developing device 40 are provided. Note that, the erasing device 60 is an optionally provided device.

In the above description, the surface of the photoreceptor 10 is negatively charged by the charging roller 20, and an electrostatic charge image is formed on the charged surface of the photoreceptor 10 by the exposure device 30.

Hereinafter, the developing device 40 will be described. The developing device 40 is disposed to face the photoreceptor 10 in a developing area and includes, for example, a developer container 41 that accommodates two-component developer including a toner charged in negative (−) polarity and a carrier charged in positive (+) polarity. The developer container 41 includes a developer container main member 41A and a developer container cover 41B that covers the upper end of the developer container main member.

The developer container main member 41A includes, inside thereof, a developing roller chamber 42A that accommodates a developing roller 42 (an examples of the developer holding member), a first stirring chamber 43A which is adjacent to the developing roller chamber 42A, and a second stirring chamber 44A which is adjacent to the first stirring chamber 43A. In addition, in the developing roller chamber 42A, a layer thickness regulating roller 45 (an example of the layer thickness regulating member) that regulates the layer thickness of the developer on the surface of the developing roller 42 when a developer container cover 41B is mounted on the developer container main member 41A is provided.

Here, as the layer thickness regulating member, an example in which the layer thickness regulating roller 45 (for example, a columnar or cylindrical member made of resin or metal) is applied is described; however, in the layer thickness regulating member, a portion facing the developing roller 42 may be a plate portion made of resin or metal having a curved surface.

The first stirring chamber 43A and the second stirring chamber 44A is partitioned by a partition wall 41C provided therebetween, and the first stirring chamber 43A and the second stirring chamber 44A communicate with each other with opening (not shown) at both ends portion of the partition wall 41C in the longitudinal direction (in the longitudinal direction of the developing device). The first stirring chamber 43A and the second stirring chamber 44A constitute a circulating stirring chamber (43A+44A).

In the developing roller chamber 42A, the developing roller 42 is disposed to face the photoreceptor 10, and the developing roller 42 and the photoreceptor 10 are rotated in a reverse direction. The developing roller 42 is provided with a sleeve on the outside of a magnetic roller (fixed magnet) having magnetism. The developer present in the first stirring chamber 43A is adhered onto the surface of the developing roller 42 by the magnetic force of the magnetic roller. In addition, in the developing roller 42, the roller axis is rotatably supported by developer container main member 41A.

A bias power source (not shown) is connected to the sleeve of the developing roller 42, and for example, a developing bias obtained by superimposing a direct current component (DC) on an alternating current component (AC) is applied.

The first stirring chamber 43A and the second stirring chamber 44A respectively include a first stirring member 43 (a stirring and feeding member) and a second stirring member 44 (stirring and feeding member) that stir and supply the developer are disposed. The first stirring member 43 is formed of a first rotation shaft extending in the axial direction of the developing roller 42, and a stirring and feeding blade (a protrusion portion) spirally fixed to the outer periphery of the rotation shaft. Similarly, the second stirring member 44 is formed of a second rotation shaft and a stirring and feeding blade (a protrusion portion). Note that, the stirring member is rotatably supported by the developer container main member 41A. In addition, due to the rotation, the first stirring member 43 and the second stirring member 44 are disposed such that the developers in the first stirring chamber 43A and the second stirring chamber 44A are supplied in mutually opposite directions.

Next, the cleaning device 70 will be described. The cleaning device 70 is configured to include a housing 71 and a cleaning blade 72 which is disposed to be projected from the housing 71. The cleaning blade 72 is formed into a plate shape, and a tip end portion (hereinafter, also referred to as an edge portion) thereof is in contact with the photoreceptor 10. In addition, the cleaning blade 72 is provided on the downstream side from a position where the transferring is performed by the transfer roller 52 in the photoreceptor 10 in the rotation direction (in the counterwise direction), and on the downstream side from a position where the erasing is performed by the erasing device 60 in the rotation direction.

The cleaning blade 72 scratches and removes toners which remain on the surface of the photoreceptor 10 without being transferred to the recording paper P when the photoreceptor 10 rotates in the counterwise direction, or foreign matters such as paper powder of the recording paper P from photoreceptor 10.

Here, a known material may be used as the material of the cleaning blade 72, and examples thereof include urethane rubber, silicone rubber, fluorine rubber, chloroprene rubber, and butadiene rubber. Among them, polyurethane is particularly preferably used because it is excellent in abrasion resistance.

Further, a feeding member 73 is disposed on the bottom in the housing 71, and one end of the supply feeding path 74 is connected to the downstream side of the feeding member 73 of the housing 71 in the supply direction so as to supply the toner (developer) removed by the cleaning blade 72 to the developing device 40. In addition, the other end of the supply feeding path 74 is connected to the developing device 40 (the second stirring chamber 44A).

The cleaning device 70 supplies the toner removed by the cleaning blade 72 to the developing device 40 (the second stirring chamber 44A) in accordance with the rotation of the feeding member 73 provided on the bottom of the housing 71 through the supply feeding path 74. The collected toner supplied to the second stirring chamber 44A is stirred with the toner accommodated in the second stirring chamber 44A, and is reused. The image forming apparatus 300 applies a toner reclaim type of reusing the collected toner. Note that, the toner contained in a toner cartridge 46 is also supplied to the developing device 40 through a toner supply tube (not shown).

In addition, the toner image formed on the outer peripheral surface of the photoreceptor 10 by being pressed to the photoreceptor 10 by transfer roller 52 is transferred to the recording paper P which is transported to a position where the transfer roller 52 provided to face the photoreceptor 10 is disposed. On the downstream side of the transfer roller 52 in the paper supplying direction, a fixing device (an example of the fixing unit) including a fixing roller 100 and a roller 102 arranged to face each other, and a cam 104 are sequentially disposed. The recording paper P to which the toner image is transferred is nipped between the fixing roller 100 and the roller 102 so as to fix the toner image, and reaches a portion which a cam 104 is disposed. The cam 104 is rotationally driven by a motor (not shown) and is fixed at a position indicated by a solid line in FIG. 1 or at a position indicated by an imaginary line.

When the recording paper P reaches from the fixing roller 100 side, the cam 104 is rotationally driven to the opposite side of the fixing roller 100 (position indicated by a solid line). With this, the recording paper P having reached from the fixing roller 100 side is guided to a pair of rollers 106 along the outer peripheral surface of the cam 104. In this case, a pair of rollers 106, a pair of rollers 108, a pair of rollers 112, and a pair of rollers 114 are arranged in order on the downstream side of the recording paper P in the guide direction by the cam 104, and a paper receiver 202 is disposed on the downstream side of the pair of rollers 114 in the paper supply direction.

Accordingly, the recording paper P having reached from the fixing roller 100 side is nipped between the pairs of rollers 106 and 108, and when the pairs of rollers 106 and 108 are continuously rotated, the recording paper P is transported to the paper receiver 202.

In addition, when a surface, on which an image is formed, of recording paper P temporarily nipped between the pairs of rollers 106 and 108 is reversed to a surface on the back side of the image-formed surface, the cam 104 is rotationally driven to the fixing roller 100 side (a position indicated by an imaginary line). In this state, the rotation direction of the pairs of rollers 106 and 108 is reversed so that the supply direction of the recording paper P is reversed by a reversal supplying (hereinafter, referred to as "switchback") method, and when the recording paper P is transported from the pairs of rollers 106 and 108 side to the cam 104, the recording paper P is guided downward along the outer peripheral surface of the cam 104. In this case, a pair of rollers 120 is disposed on the downstream side of the recording paper P in the guide direction by the cam 104, and the recording paper P having reached in a portion where the pair of rollers 120 are disposed is further transported due to a supplying force applied thereto by the pair of rollers 120.

Note that, in FIG. 1, the feeding path of the recording paper P is indicated by an imaginary line.

On the downstream side in the direction in which the recording paper P is transported by the pair of rollers 120, a pair of rollers 122, a pair of rollers 124, a pair of rollers 126, a pair of rollers 128, a pair of rollers 130, and a pair of rollers 132 are arranged in order along the feeding path, indicated by the imaginary line in FIG. 1, of the recording paper P, and these pairs of rollers and cam 104, the pairs of rollers 106, 108, and 120 constitute a recording paper reverse portion 220. The recording paper P which is switched back at the portion where the pairs of rollers 106 and 108 are disposed is transported along the feeding path indicated by the imaginary line in FIG. 1 to reach the position where the pair of rollers 90 is disposed, and then transported again to a nip portion between the photoreceptor 10 and the transfer roller 52.

At this time, in a case where the recording paper P is switched back at the recording paper reverse portion 220 as described above, and thus the surface on the back side of the surface on which the image is previously formed is inverted so as to face the photoreceptor 10 side, the toner image is transferred to the back side surface so as to be fixed by the fixing roller 100, the image is formed on surfaces on both sides. The recording paper P on which the image is formed on surfaces on both sides is discharged to the paper receiver 202 with the surface, on which the image is formed later, being on the back side. Further, in the image formation performed later (image formation after the recording paper P is inverted at the recording paper reverse portion), in a case where the image is not formed on the recording paper P, the recording paper P is discharged to the paper receiver 202 with the surface, on which the image is formed first, being on the front side.

Examples of the recording paper P for transferring the toner image include plain paper used in electrophotographic copying machines, printers, and the like. In addition to the recording paper P, examples of the recording medium also include an OHP sheet. As the recording paper P, for example, coated paper obtained by coating the surface of plain paper with a resin or the like, and art paper for printing are suitably used.

Process Cartridge and Toner Cartridge

The process cartridge according to the exemplary embodiment will be described.

The process cartridge according to the exemplary embodiment is a process cartridge which is provided a developing unit that accommodates the electrostatic charge image developer according to the exemplary embodiment, and develops electrostatic charge image formed on the surface of the image holding member with the electrostatic charge image developer to obtain a toner image, and is detachable from the image forming apparatus.

The process cartridge according to the exemplary embodiment is not limited to the above-described configuration, and may be configured to include a developing device, and as necessary, at least one selected from other units such as an image holding member, a charging unit, an electrostatic charge image forming unit, and a transfer unit.

Hereinafter, an example of the process cartridge according to this exemplary embodiment will be shown. However, the process cartridge is not limited thereto. Major parts shown in the drawing will be described, but descriptions of other parts will be omitted.

Figure 2:
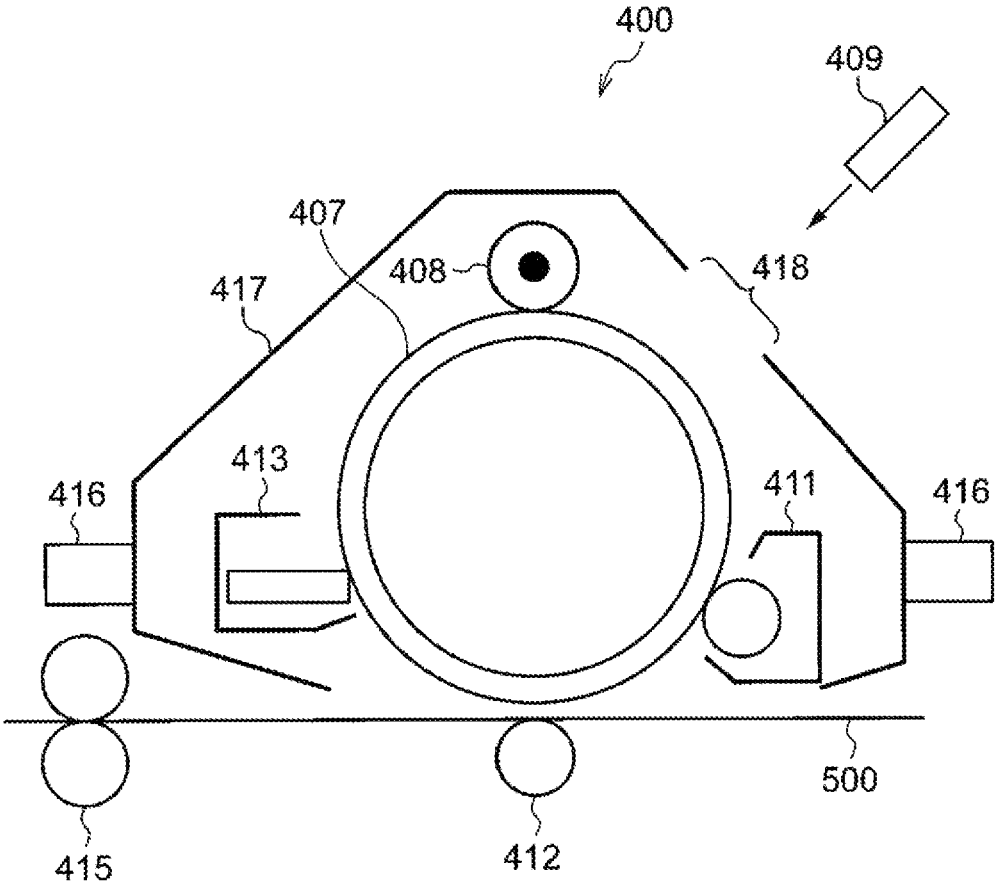
FIG. 2 is a configuration diagram illustrating an example of a process cartridge according to the exemplary embodiment.

FIG. 2 is a configuration diagram illustrating the process cartridge according to the exemplary embodiment.

A process cartridge 400 illustrated FIG. 2 is configured such that a photoreceptor (an example of the image holding member) 407, and a charging roller (an example of the charging unit) 408, a developing device (an example of the developing unit) 411, and a photoreceptor cleaning device (an example of the cleaning unit) 413 which are provided in the circumference of the photoreceptor 407 are integrally combined and held by a housing 417 provided with a mounting rail 416 and an opening 418 for exposure, and is made into a cartridge.

In addition, in FIG. 2, a reference numeral 409 represents an exposure device (an example of the electrostatic charge image forming unit), a reference numeral 412 represents a transfer device (an example of the transfer unit), a reference numeral 415 represents a fixing device (an example of the fixing unit), and a reference numeral 500 represents a recording paper (an example of the recording medium). Note that, in FIG. 2, a toner reclaim mechanism in which the toner removed by the photoreceptor cleaning device 413 is supplied to the developing device 411 through the supply feeding path (an example of the toner supply unit) so as to be reused is not illustrated.

Next, the toner cartridge according to the exemplary embodiment will be described.

The toner cartridge according to the exemplary embodiment is a toner cartridge that accommodates the toner according to the exemplary embodiment and is detachable from the image forming apparatus. The toner cartridge is to accommodate a toner for replenishment which is supplied to the developing unit provided in the image forming apparatus. Note that, the image forming apparatus as illustrated in FIG. 1 is an image forming apparatus to which the toner cartridge 46 is detachably attached, and the developing device 40 is connected to the toner cartridge 46 through a toner supply tube (not shown). In addition, in a case where the amount of the toners accommodated in the toner cartridge is decreased, the toner cartridge is replaced.

Examples

Hereinafter, the exemplary embodiment will be described in detail using Examples and Comparative examples. However, the exemplary embodiment is not limited to the following examples. In the following description, unless specifically noted, "parts" and "%" are based on the weight.

Preparation of Polyester Resin Particle Dispersion

Preparation of Polyester Resin Particle Dispersion (APE1)

Bisphenol A ethylene oxide 2.2 mol adduct: 40 parts by mol

Bisphenol A propylene oxide 2.2 mol adduct: 60 parts by mol

Dimethyl terephthalate: 60 parts by mol

Dimethyl fumarate: 15 parts by mol

Dodecenylsuccinic anhydride: 20 parts by mol

Trimellitic anhydride: 5 parts by mol

The components except for dimethyl fumarate and trimellitic anhydride among the above-described monomer components, and 0.25 parts of tin dioctanoate with respect to the total of 100 parts of the above-described monomer components are put into a reaction vessel equipped with a stirrer, a thermometer, a condenser, and a nitrogen-introducing tube. The mixture is reacted at 235° C. for six hours under nitrogen gas flow, and the temperature is decreased down to 200° C., and dimethyl fumarate and trimellitic anhydride are put into the mixture and the reaction is performed for one hour. The temperature is further increased up to 220° C. over five hours, and the mixture is polymerized under the pressure of 10 kPa until a desired molecular weight is obtained, and thereby a light yellow transparent amorphous polyester resin is obtained.

The polyester resin has a weight average molecular weight of 35,000, a number average molecular weight of 8,000, and a glass transition temperature of 59° C.

Then, the obtained polyester resin is dispersed by using a dispersion machine in which CAVITRON CD1010 (manufactured by Eurotec, Ltd.) is modified to a high temperature and high pressure type. A composition of 80% of ion exchange water and 20% of polyester resin is prepared and the pH is adjusted to 8.5 by ammonia, the CAVITRON is operated under the conditions that a rotating speed of a rotator is 60 Hz and a pressure is 5 kg/cm$^2$, a heating temperature by a heat exchanger is 140° C., and as a result, an amorphous polyester resin dispersion is obtained. The volume average particle diameter of the resin particles in the dispersion is 130 nm. The solid content is adjusted to 20% by adding the ion exchange water to the dispersion, and this dispersion is set as a polyester resin particle dispersion (APE1).

Preparation of Polyester Resin Particle Dispersion (CPE1)

1,10-dodecanedioic acid: 50 parts by mol 1,9-nonanediol: 50 parts by mol

The above-described monomer components are put into a reaction vessel equipped with a stirrer, a thermometer, a condenser, and a nitrogen-introducing tube, the inside of the reaction vessel is replaced with a dry nitrogen gas, and then 0.25 parts of titanium tetrabutoxide (reagent) is put into the reaction vessel with respect to 100 parts of the monomer components. Under nitrogen gas flow, the stirring reaction is performed at 170° C. for three hours, then the temperature is further increased up to 210° C. over one hour, the inside of the reaction vessel is depressurized to 3 kPa, and then the stirring reaction is performed for 13 hours under reduced pressure, thereby obtaining a polyester resin.

The polyester resin has a weight average molecular weight of 25,000, a number average molecular weight of 10,500, an acid vale of 10.1 mgKOH/g, and a melting temperature of 73.6° C. based on DSC.

Then, the obtained polyester resin is dispersed by using a dispersion machine in which CAVITRON CD1010 (manufactured by Eurotec, Ltd.) is modified to a high temperature and high pressure type. A composition of 80% of ion exchange water and 20% of polyester resin is prepared and the pH is adjusted to 8.5 by ammonia, the CAVITRON is operated under the conditions that a rotating speed of a rotator is 60 Hz and a pressure is 5 kg/cm$^2$, a heating temperature by a heat exchanger is 140° C., and as a result, a crystalline polyester resin dispersion is obtained. The volume average particle diameter of the resin particles in the dispersion is 180 nm. The solid content is adjusted to 20% by adding the ion exchange water to the dispersion, and this dispersion is set as a polyester resin particle dispersion (CPE1).

Preparation of Styrene (Meth)Acrylic Resin Particle Dispersion

Preparation of Styrene Acrylic Resin Particle Dispersion (StAc1)

Styrene: 77 parts n-butyl acrylate: 23 parts 1,10-decanediol diacrylate: 0.4 parts Dodecanethiol: 0.7 parts The above-described materials are mixed and dissolved to obtain a mixture, and a solution in which 1.0 parts of anionic surfactant (DOWFAX prepared by Dow Chemical Japan Limited) is dissolved in 60 parts of ion exchange water is added to the mixture, and the mixture is dispersed and emulsified in a flask, and thereby a monomer emulsion is prepared.

Subsequently, 2.0 parts of anionic surfactant (DOWFAX prepared by Dow Chemical Japan Limited) is dissolved into 90 parts of ion exchange water, and 2.0 parts of monomer emulsion is added into the mixture, and 10 parts of ion exchange water in which 1.0 parts of ammonium persulfate is dissolved is further put to the mixture.

After that, the remaining of the monomer emulsion is put into the mixture for three hours, the inside of the flask is replaced with a nitrogen gas, the mixture is heated in an oil bath until the temperature reaches 65° C. while stirring the inside of the flask, and the emulsion polymerization is continued for five hours in this state, and thereby a styrene acrylic resin particle dispersion (1) is obtained.

In the styrene acrylic resin particle dispersion (StAc1), the ion exchange water is added to adjust the solid content to 20%. In the styrene acrylic resin particle dispersion (StAc1), a volume average particle diameter of the particles is 105 nm, a weight average molecular weight is 55000, and a styrene ratio is 76.2% by weight.

Preparation of Styrene Acrylic Resin Particle Dispersion (StAc2)

A styrene acrylic resin particle dispersion (StAc2) is obtained in the same manner as in the preparation of the styrene acrylic resin particle dispersion (StAc1) except that the amount of styrene is changed to 85 parts, the amount of n-butyl acrylate is changed to 15 parts, and the amount of the anionic surfactant (DOWFAX prepared by Dow Chemical Japan Limited) is changed to 1.5 parts. The volume average particle diameter of the particles is 220 nm, the weight average molecular weight is 56,000, and the styrene ratio is 84.3% by weight.

Preparation of Styrene Acrylic Resin Particle Dispersion (StAc3)

A styrene acrylic resin particle dispersion (StAc3) is obtained in the same manner as in the preparation of the styrene acrylic resin particle dispersion (StAc1) except that the amount of styrene is changed to 90 parts, the amount of n-butyl acrylate is changed to 10 parts, and the amount of the anionic surfactant (DOWFAX prepared by Dow Chemical Japan Limited) is changed to 4.0 parts. The volume average particle diameter of the particles is 52 nm, the weight average molecular weight is 54,000, and the styrene ratio is 89.6% by weight.

Preparation of Styrene Acrylic Resin Particle Dispersion (StAc4)

A styrene acrylic resin particle dispersion (StAc4) is obtained in the same manner as in the preparation of the styrene acrylic resin particle dispersion (StAc1) except that the amount of styrene is changed to 92 parts and the amount of n-butyl acrylate is changed to 8 parts. The volume average particle diameter of the particles is 105 nm, the weight average molecular weight is 55,000, and the styrene ratio is 91.1% by weight.

Preparation of Styrene Acrylic Resin Particle Dispersion (StAc5)

A styrene acrylic resin particle dispersion (StAc5) is obtained in the same manner as in the preparation of the styrene acrylic resin particle dispersion (StAc1) except that the amount of styrene is changed to 62 parts and the amount of n-butyl acrylate is changed to 38 parts. The volume average particle diameter of the particles is 102 nm, the weight average molecular weight is 54,000, and the styrene ratio is 61.2% by weight.

Preparation of Styrene Acrylic Resin Particle Dispersion (StAc6)

A styrene acrylic resin particle dispersion (StAc6) is obtained in the same manner as in the preparation of the styrene acrylic resin particle dispersion (StAc1) except that the amount of styrene is changed to 59 parts and the amount of n-butyl acrylate is changed to 41 parts. The volume average particle diameter of the particles is 103 nm, the weight average molecular weight is 55,000, and the styrene ratio is 59.3% by weight.

Preparation of Coloring Agent Dispersion

Preparation of Black Pigment Dispersion (CL1)

Carbon black (Regal330 prepared by Cabot Corporation.): 250 parts

Anionic surfactant (NEOGEN SC prepared by Daiichi Kogyo Seiyaku Co., Ltd.): 33 parts (effective component of 60%, 8% with respect to coloring agent)

Ion exchange water: 750 parts 280 parts of ion exchange water and 33 parts of anionic surfactant are put into a stainless steel container having a size such that the height of the liquid surface is about ⅓ of the height of the container when putting all of the above materials, a surfactant is sufficiently dissolved therein, then all of the carbon blacks are put into the container, and the mixture is stirred using a stirrer until there is no pigment which is not wet and sufficiently defoamed. After defoaming, the remaining ion exchange water is added, the mixture is dispersed for 10 minutes at 5,000 rpm by using a homogenizer (ULTRA TURRAX T50 manufactured by IKA Ltd.), and the mixture is defoamed by being stirred overnight with the stirrer. After defoaming, the mixture is dispersed again for 10 minutes at 6,000 rpm by using a homogenizer and then is defoamed by being stirred overnight with the stirrer. Subsequently, the dispersion is dispersed at a pressure of 240 MPa by suing a high pressure impact type dispersing machine Ultimizer (HJP30006: manufactured by Sugino Machine Limited Co., Ltd). The dispersion is performed 25 times in terms of the total amount of the charged materials and the processing capacity of the apparatus. The obtained dispersion is allowed to stand for 72 hours to remove a precipitate and ion exchange water is added to adjust the solid content to 15%, and thereby a black pigment dispersion (CL1) is obtained. The volume average particle diameter of the particles in the black pigment dispersion (CL1) is 135 nm.

Preparation of Release Agent Particle Dispersion

Preparation of Release Agent Particle Dispersion (WAX1)

Polyethylene wax (Hydrocarbon wax, POLY WAX 725 prepared by BAKER PETROLITE, melting temperature 104° C.): 270 parts Anionic surfactant (NEOGEN RK prepared by Daiichi Kogyo Seiyaku Co., Ltd.): 13.5 parts (effective component of 60%, 3% with respect to release agent Ion exchange water: 21.6 parts The above-described materials are mixed, the release agent is dissolved at an inner liquid temperature of 120° C. by using a pressure discharge type homogenizer (Gaulin homogenizer manufactured by Gaulin, Inc.), then the dispersion agent is dispersed at a dispersion pressure of 5 MPa for 120 minutes, is subsequently dispersed at 40 MPa for 360 minutes, and cooled so as to obtain a dispersion. The ion exchange water is added to adjust the solid content to 20%, and thereby the obtained dispersion is set as a release agent particle dispersion (WAX1). The volume average particle diameter of the particles in the release agent particle dispersion (WAX1) is 225 nm.

Preparation of Mixed Particle Dispersion

Preparation of Mixed Particle Dispersion (PESA1)

405 parts of polyester resin particle dispersion (APE1), 30 parts of styrene acrylic resin particle dispersion (StAc2), and 3 parts of anionic surfactant (DOWFAX2A1 prepared by Dow Chemical Japan Limited) are mixed with each other, 1.0% of nitric acid is added to the mixture under the temperature of 25° C. so as to adjust the pH to 3.0, and thereby a mixed particle dispersion (PESA1) is obtained.

Preparation of Mixed Particle Dispersion (PESA2)

A mixed particle dispersion (PESA2) is obtained by using the same method as that used in the case of the mixed particle dispersion (PESA1) except that each styrene acrylic resin particle dispersion (StAc1) is changed to styrene acrylic resin particle dispersion (StAc2).

Preparation of Toner Particles

Preparation of Toner Particles (TN1)

Polyester resin particle dispersion (APE1): 525 parts

Polyester resin particle dispersion (CPE1): 75 parts

Styrene acrylic resin particle dispersion (StAc1): 300 parts

Black pigment dispersion (CL1): 120 parts

Release agent particle dispersion (WAX1): 60 parts

Ion exchange water: 600 parts

Anionic surfactant (DOWFAX2A1 prepared by Dow Chemical Japan Limited): 2.9 parts The above materials are, as core forming materials, put into a 3 liter reaction vessel equipped with a thermometer, a pH meter, and a stirrer, 1.0% of nitric acid is added to the mixture at a temperature of 25° C. to adjust the pH to 3.0, and then 100 parts of aluminum sulfate aqueous solution having a concentration of 2.0% is added and dispersed for six minutes while stirring at 5,000 rpm with a homogenizer (ULTRA TURRAX T50, manufactured by IKA Co., Ltd).

After that, a stirrer and a mantle heater are installed in the reaction vessel, the temperature is raised at a rate of 0.2° C./min up to a temperature of 40° C., and the temperature is raised at a rate of temperature rise of 0.05° C./min in a temperature range of higher than 40° C. to 53° C. while adjusting the rotation speed of the stirrer so that the slurry is sufficiently stirred, and the particle diameter is measured every ten minutes by using COULTER MULTISIZER II (aperture diameter of 50 μm, manufactured by Beckman Coulter, Inc.). When the volume average particle diameter is 5.0 μm, the temperature is kept, and as a shell layer forming material, 450 parts of mixed particle dispersion (PESA1) is put into the reaction vessel for five minutes.

After keeping the temperature at 50° C. for 30 minutes, 8 parts of 20% ethylenediaminetetraacetic acid (EDTA) solution is added to the reaction vessel, and then 1 mol/L sodium hydroxide aqueous solution is added so as to control the pH of the raw material dispersion to 9.0. Thereafter, the temperature is raised up to 90° C. at a heating rate of 1° C./min, and the temperature is kept at 90° C. while adjusting the pH to 9.0 at every 5° C. The particle shape and the surface property are observed with an optical microscope and a field emission type scanning electron microscope (FE-SEM), and it is confirmed that the particles are coalesced at sixth hour, and the vessel is cooled down to 30° C. with cooling water over five minutes.

The cooled slurry is allowed to pass through a nylon mesh having an opening of 15 μm to remove coarse powder, and the toner slurry that has passed through the mesh is filtered under reduced pressure with an aspirator. The solid content remaining on the filter paper is pulverized as finely as possible by hand, then put into ion exchange water at 10 times the solid content at a temperature of 30° C., and the mixture is stirred for 30 minutes. Then, the toner slurry is filtered under the reduced pressure with the aspirator, the solid content remaining on the filter paper is pulverized as finely as possible by hand, and put into ion exchange water at 10 times the solid content at a temperature of 30° C., the mixture is stirred for 30 minutes, and after that, filtering is performed again under the reduced pressure with the aspirator so as to measure the electric conductivity of the filtrate. The filtrate is again filtered under, and the electric conductivity of the filtrate is measured. This operation is repeatedly performed until the electric conductivity of the filtrate is equal to or lower less 10 μS/cm, and the solid content is washed.

The washed solid content is pulverized finely by using a wet and dry type particle size regulator (comil) and is vacuum-dried in an oven at 35° C. for 36 hours, and thereby toner particles (TN1) are obtained. The volume average particle diameter of the toner particles (TN1) is 6.0 μm.

Preparation of Toner Particles (TN2) to (TN9)

Each of toner particles (TN2) to (TN9) is obtained by using the same method as that used in the case of the toner particles (TN1) except that the kind and the amount (by parts) of the core forming material (polyester resin particle dispersion and styrene acrylic resin particle dispersion) and the shell forming material (mixed particle dispersion) are changed as indicated in Table 1.

Preparation of External Additives

Preparation of Oil-Treated Silica Particles (EA1)

After mixing $SiCl_4$, hydrogen gas, and oxygen gas in a mixing chamber of a combustion burner, and the mixture is burned at a temperature range from 1,000° C. to 3,000° C. Silica particles are obtained by collecting silica powders from the gas after combustion. At this time, silica particles (R1) having volume average particle diameter (D50v) of 65 nm are obtained by setting the mole ratio of the hydrogen gas to the oxygen gas to be 1.28:1.

100 parts of silica particles (R1) and 500 parts of ethanol are put into an evaporator, and the mixture is stirred for 15 minutes while keeping the temperature at 40° C. Then, 10 parts of dimethyl silicone oil is added to 100 parts of silica particles, the mixture is stirred for 15 minutes, then 10 parts of dimethyl silicone oil is further added to 100 parts of silica particles, and the mixture is stirred for 15 minutes. Lastly, the temperature is raised to 90° C. to perform drying, and ethanol is removed under the reduced pressure. After that, the treated material is taken out and is further vacuum-dried at 120° C. for 30 minutes, and thus, oil-treated silica particles (EA1) having the volume average particle diameter (D50v) of 115 nm and 12.2% by weight of the liberated oil are obtained.

Preparation of Oil-Treated Silica Particles (EA2)

Oil-treated silica particles (EA2) having the volume average particle diameter (D50v) of 65 nm and 5.8% by weight of liberated oil are obtained by using the same method as that used in the case of the oil-treated silica particles (EA1) except that mole ratio of the hydrogen gas to the oxygen gas is changed to be 1.83:1, and the amount of the dimethyl silicone oil is changed to be 6 parts.

Preparation of Oil-Treated Silica Particles (EA3)

Oil-treated silica particles (EA3) having the volume average particle diameter (D50v) of 175 nm and 29.5% by weight of liberated oil are obtained by using the same method as that used in the case of the oil-treated silica particles (EA1) except that mole ratio of the hydrogen gas to the oxygen gas is changed to be 1.22:1, and the amount of the dimethyl silicone oil is changed to be 30 parts.

Preparation of Silane Coupling Agent Treated Silica Particles (EA4)

100 parts of silica particles (R1) and 500 parts of ethanol which are used for preparation of oil-treated silica particles (EA1) and 500 parts of ethanol are put into in an evaporator and stirred for 15 minutes while keeping the temperature at 40° C. Then, 20 parts of hexamethyldisilazane is added to 100 parts of silica particles, the mixture is stirred for 15 minutes, and the mixture is stirred for 15 minutes. Lastly, the temperature is raised to 90° C., the ethanol is dried under the reduced pressure, after that, the treated material is put out so as to be further vacuum-dried at 120° C. for 30 minutes, and thus, silane coupling agent treated silica particles (EA4) having a volume average particle diameter (D50v) of 65 nm are obtained.

Preparation of Carrier

Preparation of Carrier (PCA1)

500 parts of spherical magnetite particle powder having an average particle diameter of 0.35 μm is put into a HENSCHEL MIXER and after sufficient stirring, 5.0 parts of titanate coupling agent is added thereto, the temperature is raised to approximately 100° C., and the mixture is thoroughly stirred for 30 minutes so as to obtain spherical magnetite particles coated with a titanate coupling agent.

Next, in a 1 L of four-necked flask, 6.50 parts of phenol, 9.50 parts of 35% formalin, 500 parts of the above lipophilic-treated magnetite particles, 6.25 parts of 25% ammonia aqueous solution, and 450 parts of water are stirred and mixed. Then, the temperature is raised up to 85° C. over 60 minutes while the mixture is stirred, and the reaction is performed at the same temperature for 120 minutes. After that, the temperature is lowered to 25° C., 500 ml of water is added, the supernatant is removed, and the precipitate is washed with water. The precipitate is dried under the reduced pressure in a temperature range from of 150° C. to 180° C. so as to obtain core particles 1 having a particle diameter of 35 μm.

3.00 parts of melamine, 5.00 parts of 35% formalin, 6.25 parts of 25% ammonia water, and 428 parts of water are added, and the mixture is stirred. Thereafter, while stirring, the temperature is raised up to 90° C. over 60 minutes and the reaction is performed for three hours.

After that, the temperature is lowered to 25° C., 500 ml of water is added, the supernatant is removed, the precipitate is washed with water and dried with air, and then the coarse powder is removed with a sieve mesh having an opening of 106 μm so as to obtain core particles 2 having the diameter of 35 μm.

A resin coating layer forming raw material solution A composed of the following components is stirred and dispersed with a stirrer for 60 minutes to prepare a coating layer forming raw material solution A. Next, 100 parts of the resin coating layer forming raw material solution A and the core particles 2 are put into a vacuum degassing type kneader, and the mixture is stirred at 70° C. for 30 minutes, and further degassed under the reduced pressure. Further, the resultant is allowed to pass through a mesh having an opening of 75 μm so as to obtain a carrier (PCA 1) (polymerization carrier).

Component of Resin Coating Layer Forming Raw Material Solution A

Toluene: 18 parts

Copolymer of styrene-methacrylate (copolymerization ratio of 20:80): 3.5 parts

Carbon black (Regal330 prepared by Cabot Corporation): 0.6 parts

Melamine resin particles (Epostar S 0.3 μm; prepared by Nippon Shokubai Co., Ltd.): 0.2 parts Preparation of Carrier (PCA2)

A carrier (PCA2) (polymerization carrier) is obtained by using the same method as that used in the case of the carrier (PCA1) (polymerization carrier) except that as the spherical magnetite particle, 300 parts of spherical magnetite particle powder having an average particle diameter of 0.55 μm and 200 parts of spherical magnetite particle powder having an average particle diameter of 0.15 μm are used.

Preparation of Carrier (PCA3)

A carrier (FCA3) (polymerization carrier) is obtained by using the same method as that used in the case of the carrier (PCA1) (polymerization carrier) except that as the spherical magnetite particle, 500 parts of spherical magnetite particle powder having an average particle diameter of 0.75 μm are used, and the melamine treatment is not performed.

Preparation of Carrier (PCA4)

carrier (PCA4) (polymerization carrier) is obtained by using the same method as that used in the case of the carrier (PCA1) (polymerization carrier) except that as the spherical magnetite particle, 500 parts of spherical magnetite particle powder having an average particle diameter of 0.15 μm are used and the melamine treatment is not performed.

Preparation of Carrier (PCA5)

A carrier (PCA5) (polymerization carrier) is obtained in the same manner as in the preparation of the carrier (PCA4) (polymerization carrier) except that the amount of the copolymer of styrene-methacrylate (component ratio of 20:80) is changed to 1.5 parts.

Preparation of Carrier (FCA1)

24 parts of MnO, 1 part of MgO, and 75 parts of $Fe_2O_3$ are sufficiently mixed with each other, and the raw material mixtures are mixed and pulverized with a wet ball mill for 10 hours, then the raw materials are finely pulverized and dispersed using a rotary kiln, kept at 900° C. for one hour, and temporarily fired. The obtained temporarily fired material is pulverized with a wet ball mill for 10 hours to obtain an oxide slurry having an average particle diameter of 0.4 μm. An appropriate amount (0.3% with respect to 100% of the oxide slurry) of each of a dispersant and polyvinyl alcohol is added to the obtained slurry, and then granulation and drying are performed with a spray dryer, and then main firing is performed in a rotary electric furnace at a temperature of 1,150° C. and an oxygen concentration of 0.3% which are kept for 7 hours. The obtained ferrite particles are magnetically activated, and mixed so as to obtain ferrite particles.

A carrier (FCA1) (packing carrier) is obtained in the same manner as in the preparation of the carrier (PCA1) except for adding the resin coating layer forming raw material solution A to 100 parts of the ferrite particles.

Preparation of Carrier (FCA2)

1000 parts of ferrite particles prepared in the carrier (FCA1) is put into a HENSCHEL and is sufficiently stirred, then 5.0 parts of a titanate coupling agent is added thereto, the temperature is raised to approximately 100° C., and the mixture is thoroughly stirred for 30 minutes to obtain ferrite particles coated with a titanate coupling agent.

Next, 1.50 parts of phenol, 2.50 parts of 35% formalin, 3.00 parts of 25% ammonia aqueous solution, and 250 parts of water are added to a 1 L four-necked flask and the mixture is stirred. Thereafter, while stirring, the temperature is raised up to 90° C. over 60 minutes and the reaction is performed for three hours.

After that, the temperature is lowered to 25° C., 500 ml of water is added, the supernatant is removed, the precipitate is washed with water and dried with air, and then the coarse powder is removed with a sieve mesh having an opening of 106 μm so as to obtain ferrite particles having the diameter of 35 μm.

A carrier (FCA2) (packing carrier) is obtained in the same manner as in the preparation of the carrier (PCA1) by adding the resin coating layer forming raw material solution A to 100 parts of ferrite particles.

Preparation of Carrier (FCA3)

A carrier (FCA3) is obtained in the same manner as in the preparation of the carrier (FCA1) except that the temporarily fired material is changed to have a pulverized average particle size of 0.8 μm with a wet ball mill.

Preparation of Carrier (FCA4)

A carrier (FCA4) is obtained in the same manner as in the preparation of the carrier (FCA1) except that the temporarily fired material is changed to have a pulverized average particle size of 1.5 μm with a wet ball mill. Examples 1 to 13, and Comparative Examples 1 to 5

With the combination indicated in Table 3, 1.5 parts of an external additive are added to 100 parts of toner particles and are mixed with each other at 13,000 rpm for 30 seconds by using a sample mill. Thereafter, the mixture is sieved with a vibration sieve having an opening of 45 μm so as to obtain a toner.

With the combination indicated in Table 3, 8 parts of the obtained toner and 100 parts of the carrier are mixed with a V blender to prepare the developer in each example.

Measurement

Regarding the toner particles of the obtained developer in each Example, in accordance with the above-described methods, the exposure rate (denoted as "StAc exposure rate" in Table) of the styrene (meth)acrylic resin on the surface of the toner particle, the island portion domain diameter of the styrene (meth)acrylic resin on the surface of the toner particle (denoted as "the island portion domain diameter of StAc resin on the surface of the toner particle" in Table), and the domain diameter of the styrene (meth)acrylic resin in the inside of the toner particle (denoted as "domain diameter of the StAc resin in the inside of the toner particle" in Table) are measured.

As for the toner particles of the developer obtained in each Example, the presence or absence of the sea-island structure on the surface of the toner particle in accordance with the method described above is confirmed, and as a result, it is found that the surface of the toner particle of the developer obtained in Examples 1 to 13, and Comparative Examples 1 to 5 has a sea-island structure formed of a sea portion including a polyester resin and an island portion including a styrene acrylic resin.

Measurement

With the developer obtained in each Example, the occurrence of the white streaky (streaky image defects) of the image is evaluated (referred to as "white streaky evaluation").

White Streaky Evaluation

A developing device (developing device with the layer regulating member as a metal roller) as an evaluation machine "D136 Light Publisher (manufactured by Fuji Xerox Co., Ltd.)" is filled with the prepared developer. Using this evaluation machine, images with an image density (AC) of 1% are printed on one side of 10,000 pieces of P paper (A4 paper, manufactured by Fuji Xerox Co., Ltd.) in a high humidity environment (under 30°/70RH % environment). Next, the same images are printed on both sides of 10,000 pieces of P paper. Then, on the next day (after 24 hours passed), a halftone image with an image density of 50% is printed on three pieces of P paper, the images printed on the three pieces of P paper are observed, and the white streak evaluation is performed based on the following evaluation criteria.

White Streaky Evaluation Criteria

A: No white streaks

B: White streaks are recognized depending on the angle, and a level at which there is practically no problem C: There are slightly white streaks, and a level at which a problem actually occurs D: There are obvious white streaks, and a level at which a problem actually occurs In the following description, the materials used, the developers in the respective Examples, the evaluation results, and the like are indicated in Tables 1 to 3.

TABLE 1

| | Core forming materials kind/amount | Shell forming materials kind/amount | StAc resin amount (% by weight, to toner particles) | Exposure rate of StAc (atom %) | Island portion domain diameter of StAc resin on surface of toner particle (μm) | Domain diameter of StAc resin inside of toner particle (μm) |
|---|---|---|---|---|---|---|
| Toner particles TN1 | (APE1)/525 parts (CPE1)/75 parts (StAc1)/300 parts | (PESA1)/450 parts | 20 | 10.0 | 0.3 | 0.6 |
| Toner particles TN2 | (APE1)/795 parts (CPE1)/75 parts (StAc2)/45 parts | (PESA2)/435 parts | 5 | 5.5 | 0.2 | 0.5 |
| Toner particles TN3 | (APE1)/375 parts (CPE1)/75 parts (StAc1)/450 parts | (PESA1)/450 parts | 30 | 19.0 | 0.6 | 0.9 |

TABLE 1-continued

| | Core forming materials kind/amount | Shell forming materials kind/amount | StAc resin amount (% by weight, to toner particles) | Exposure rate of StAc (atom %) | Island portion domain diameter of StAc resin on surface of toner particle (μm) | Domain diameter of StAc resin inside of toner particle (μm) |
|---|---|---|---|---|---|---|
| Toner particles TN4 | (APE1)/930 parts (CPE1)/75 parts (StAc1)/45 parts | (PESA1)/300 parts | 3 | 4.5 | 0.3 | 0.5 |
| Toner particles TN5 | (APE1)/375 parts (CPE1)/75 parts (StAc2)/450 parts | (PESA1)/450 parts | 30 | 21.0 | 0.7 | 1.1 |
| Toner particles TN6 | (APE1)/725 parts (CPE1)/75 parts (StAc3)/250 parts | (PESA1)/250 parts (StAc3)/50 parts | 20 | 16.2 | 0.2 | 0.4 |
| Toner particles TN7 | (APE1)/675 parts (CPE1)/75 parts (StAc4)/300 parts | (PESA1)/300 parts | 20 | 17.8 | 0.5 | 0.8 |
| Toner particles TN8 | (APE1)/525 parts (CPE1)/75 parts (StAc5)/150 parts | (PESA1)/450 parts | 10 | 6.7 | 0.4 | 0.6 |
| Toner particles TN9 | (APE1)/525 parts (CPE1)/75 parts (StAc6)/150 parts | (PESA1)/450 parts | 10 | 6.1 | 0.4 | 0.6 |

TABLE 2

| | D50 (μm %) | Fluidity (sec/50 g) | Bulk density (g/cm$^3$) | Fluidity × Bulk density |
|---|---|---|---|---|
| Carrier PCA 1 | 36 | 37 | 1.82 | 67.34 |
| Carrier PCA 2 | 34 | 39 | 1.85 | 72.15 |
| Carrier PCA 3 | 34 | 40 | 1.83 | 73.2 |
| Carrier PCA 4 | 37 | 36 | 1.82 | 65.52 |
| Carrier PCA 5 | 37 | 35 | 1.84 | 64.4 |
| Carrier FCA 1 | 36 | 30 | 2.25 | 67.5 |
| Carrier FCA 2 | 35 | 28 | 2.34 | 65.52 |
| Carrier FCA 3 | 37 | 32 | 2.25 | 72 |
| Carrier FCA 4 | 36 | 33 | 2.23 | 73.59 |

From the above results, it is understood that the developer in Examples prevents the occurrence of the white streaks as compared with the developer in Comparative Examples.

The developer in Example 1 is used to evaluate the white streak with an evaluation device "D136 Light Publisher (manufactured by Fuji Xerox Co., Ltd.)" in which the layer regulating member of the developing device is defined as "a metal plate having a flat portion facing the developing roller", as a result, it is confirmed that there is a tendency that the white streak slightly occurs as compared with white streak evaluation by the evaluation device in which the layer regulating member of the developing device is used as a metal roller.

TABLE 3

| | Toner | | | Carrier | | Evaluation |
|---|---|---|---|---|---|---|
| | Toner particles | | External additives | | | |
| | Types | StAc exposure rate (atom %) | Types | Types | Fluidity × Bulk density | of white streaky |
| Example 1 | TN1 | 10.0 | EA1 | PCA1 | 1.35 | A |
| Example 2 | TN1 | 10.0 | EA1 | FCA1 | 1.35 | A |
| Example 3 | TN2 | 5.5 | EA1 | PCA2 | 1.44 | B |
| Example 4 | TN2 | 5.5 | EA1 | FAC2 | 1.31 | B |
| Example 5 | TN3 | 19.0 | EA1 | PCA4 | 1.31 | B |
| Example 6 | TN3 | 19.0 | EA1 | FCA3 | 1.44 | B |
| Comparative Example 1 | TN4 | 4.5 | EA1 | PCA1 | 1.35 | D |
| Comparative Example 2 | TN5 | 21.0 | EA1 | PCA1 | 1.35 | C |
| Comparative Example 3 | TN2 | 5.5 | EA1 | PCA3 | 1.46 | D |
| Comparative Example 4 | TN3 | 19.0 | EA1 | PCA5 | 1.29 | C |
| Comparative Example 5 | TN3 | 19.0 | EA1 | FCA4 | 1.47 | D |
| Example 7 | TN1 | 10.0 | EA2 | PCA1 | 1.35 | A |
| Example 8 | TN1 | 10.0 | EA3 | PCA1 | 1.35 | A |
| Example 9 | TN1 | 10.0 | EA4 | PCA1 | 1.35 | B |
| Example 10 | TN6 | 16.2 | EA1 | PCA1 | 1.35 | A |
| Example 11 | TN7 | 17.8 | EA1 | PCA1 | 1.35 | B |
| Example 12 | TN8 | 6.7 | EA1 | PCA1 | 1.35 | A |
| Example 13 | TN9 | 6.1 | EA1 | PCA1 | 1.35 | B |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developer comprising:

a toner that includes toner particles which contain a polyester resin and a styrene (meth)acrylic resin and form a sea-island structure which includes a sea portion containing the polyester resin and an island portion containing the styrene (meth)acrylic resin on a surface of the toner particle, and has an exposure rate of the styrene (meth)acrylic resin on the surface of the toner particle in a range of from 5 atom % to 20 atom % determined by a peak separation method of a C1S spectrum obtained through X-ray photoelectron spectroscopy of the toner particle; and an external additive, and a carrier whose fluidity in units of sec/50 g and bulk density in units of g/cm$^3$ under an environment of a temperature of 25° C. and a humidity of 50% satisfy Expression: 65.0≤fluidity×bulk density≤72.5, wherein the fluidity of the carrier is from 25.0 sec/50 g to 40.0 sec/50 g.

2. The electrostatic charge image developer according to claim 1, wherein the exposure rate of the styrene (meth)acrylic resin is from 10 atom % to 20 atom %.

3. The electrostatic charge image developer according to claim 1, wherein as the external additive, oil-treated silica particles are externally added to the toner.

4. The electrostatic charge image developer according to claim 3, wherein a volume average particle diameter of the oil-treated silica particles is from 50 nm to 200 nm.

5. The electrostatic charge image developer according to claim 3, wherein an amount of a liberated oil of the oil-treated silica particles is from 3% by weight to 15% by weight.

6. The electrostatic charge image developer according to claim 1, wherein a styrene ratio of the styrene (meth)acrylic resin is 60% by to 90% by weight.

7. The electrostatic charge image developer according to claim 1, wherein a weight ratio (polyester resin/styrene (meth) acrylic resin) of the polyester resin to the styrene (meth)acrylic resin is from 100/50 to 100/6.

8. The electrostatic charge image developer according to claim 1, wherein a domain diameter of the island portion of the styrene (meth)acrylic resin on the surface of the toner particle is from 0.1 μm to 0.6 μm.

9. The electrostatic charge image developer according to claim 1, wherein a domain diameter of the island portion of the styrene (meth)acrylic resin on the surface of the toner particle is from 0.3 μm to 0.5 μm.

10. The electrostatic charge image developer according to claim 1, wherein a domain diameter of the island portion of the styrene (meth)acrylic resin inside the toner particle is from 0.3 μm to 1.5 μm.

11. The electrostatic charge image developer according to claim 1, wherein a domain diameter of the island portion of the styrene (meth)acrylic resin inside per QS the toner particle is from 0.4 μm to 1.0 μm.

12. The electrostatic charge image developer according to claim 1, wherein an average interval Sm of a surface irregularity of a core of the carrier is 2.0 μm or less, or a surface roughness Ra of a core of the carrier is 0.1 μm or more.

13. The electrostatic charge image developer according to claim 1, wherein an average roughness Ra of the carrier surface is from 0.20 μm to about 0.25 μm.

14. A developer cartridge comprising:

a container that contains the electrostatic charge image developer according to claim 1, and wherein the developer cartridge is detachable from an image forming apparatus.

15. A process cartridge comprising:

a developing unit that contains the electrostatic charge image developer according to claim 1, and develops an electrostatic charge image formed on a surface of an image holding member with the electrostatic charge image developer to obtain a toner image, wherein the process cartridge is detachable from an image forming apparatus.

16. The process cartridge according to claim 15, wherein the developing unit includes a developer holding member that is disposed so as to face the surface of the image holding member and holds the electrostatic charge image developer on the surface, and a layer regulating member that regulates a layer thickness of the electrostatic charge image developer held by the developer holding member, and has a portion bent toward the developer holding member.

* * * * *